US005542746A

United States Patent [19]

Bujaryn

[11] Patent Number: 5,542,746

[45] Date of Patent: Aug. 6, 1996

[54] VARIABLE POSTURE COMPONENT SYSTEM SEATING DEVICE

[76] Inventor: L. Walter Bujaryn, P.O. Box 5244, Vail, Colo. 81658-5244

[21] Appl. No.: 210,178

[22] Filed: Mar. 17, 1994

[51] Int. Cl.[6] ..... A47C 7/50

[52] U.S. Cl. ..... 297/423.12; 297/423.13; 297/172; 297/135; 297/411.32; 297/344.19; 297/313; 297/301.1; 297/488; 297/404

[58] Field of Search ..... 297/187, 423.11, 297/423.12, 423.13, 423.26, 174, 172, 161, 153, 160, 411.32, 488, 301, 306, 115, 145, 464, DIG. 4, DIG. 10, 423.1, 116, 411.37, 487; 297/397, 391, 173, 300.1, 300.2, 300.5, 301.1, 301.4, 135, 344.19, 313, 337, 404, 440.14

[56] References Cited

U.S. PATENT DOCUMENTS

| | | | |
|---|---|---|---|
| 454,100 | 6/1891 | Wilson . | |
| 1,527,754 | 2/1925 | Simon | 297/464 X |
| 2,364,050 | 12/1944 | Benson . | |
| 2,767,778 | 10/1956 | Kriger et al. | 297/411.32 X |
| 3,165,314 | 1/1965 | Clearman et al. . | |
| 3,338,626 | 8/1967 | Hamilton | 297/115 |
| 3,754,787 | 8/1973 | Garber | 297/390 |
| 4,328,991 | 5/1982 | Mengshoel et al. | 297/271 |
| 4,589,699 | 5/1986 | Dungan | 297/423 |
| 4,607,882 | 8/1986 | Opsvik | 297/195 |
| 4,650,249 | 3/1987 | Serber | 297/313 |
| 4,765,684 | 8/1988 | Kvalheim et al. | 297/429 |
| 4,767,159 | 8/1988 | Opsvik | 297/423 |
| 4,767,160 | 8/1988 | Mengshoel et al. | 297/423.12 |
| 4,813,746 | 3/1989 | Mulholland | 297/464 X |
| 4,832,407 | 5/1989 | Serber | 297/437 |
| 4,880,270 | 11/1989 | Cooper | 297/188 |
| 4,925,240 | 5/1990 | Peters | 297/161 |
| 4,943,117 | 7/1990 | Brown | 297/392 |
| 5,004,253 | 4/1991 | Nakao et al. | 297/488 X |
| 5,054,852 | 10/1991 | Thelkes | 297/172 |
| 5,054,857 | 10/1991 | Kvalheim | 297/423 |
| 5,056,864 | 10/1991 | Cooper | 297/188 |
| 5,062,676 | 11/1991 | Mars | 297/338 |
| 5,169,210 | 12/1992 | Fricano | 297/188 |
| 5,174,631 | 12/1992 | Schaevitz | 297/438 |
| 5,186,519 | 2/1993 | Larson | 297/423 |
| 5,255,957 | 10/1993 | Opsvik et al. | 297/423.12 |
| 5,275,465 | 1/1994 | Gulliver et al. | 297/411 |

*Primary Examiner*—Milton Nelson, Jr.

*Attorney, Agent, or Firm*—Ramon L. Pizarro; Edwin H. Crabtree

[57] ABSTRACT

The present design is of a variable posture component system seating device, also called a work chair, which integrates user selectable and adjustable components. The components consist generally of a short base, a long base, height adjustment mechanisms, a seat adjustment mechanism, a seat assembly, right and left arm rest assemblies, an abdominal rest assembly, a back rest assembly, a head rest assembly, a knee/leg rest assembly, a keyboard desk assembly, an auxiliary desk assembly, a horizontal work surface assembly, and a variety of interconnecting hardware. Numerous improvements to a variable posture work chair are incorporated into the design, which can benefit workers subjected to extended periods of immobilization as well as the infirm and the injured. Fore and aft support from a single seated position is provided over the entire range of leaning normally associated with human sitting. A variety of work surfaces may be incorporated into the design, and certain of these may be mounted to the chair by using arm rests which may also be moved between positions of use and nonuse. Components may be added, removed, or displaced to accommodate specific physical and workplace needs. An elongated low profile chair base of single unit construction provides stability to the chair assembly while allowing for maximum leg and foot clearance. Suggested uses are in the home, office, and industrial work place.

19 Claims, 16 Drawing Sheets

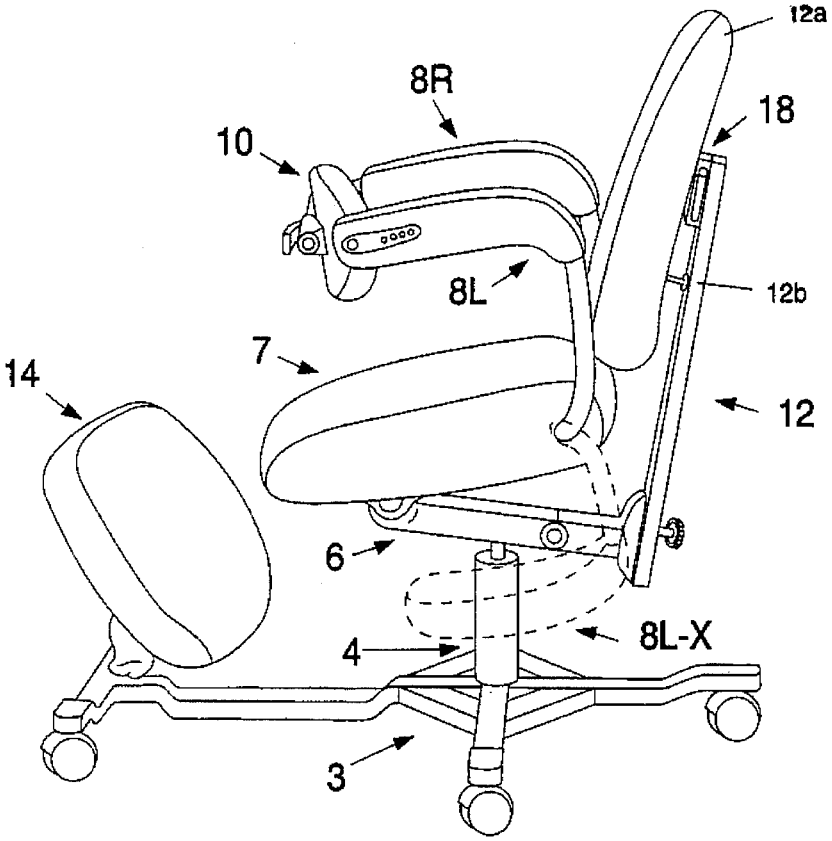
FIG. 3
FIG. 4
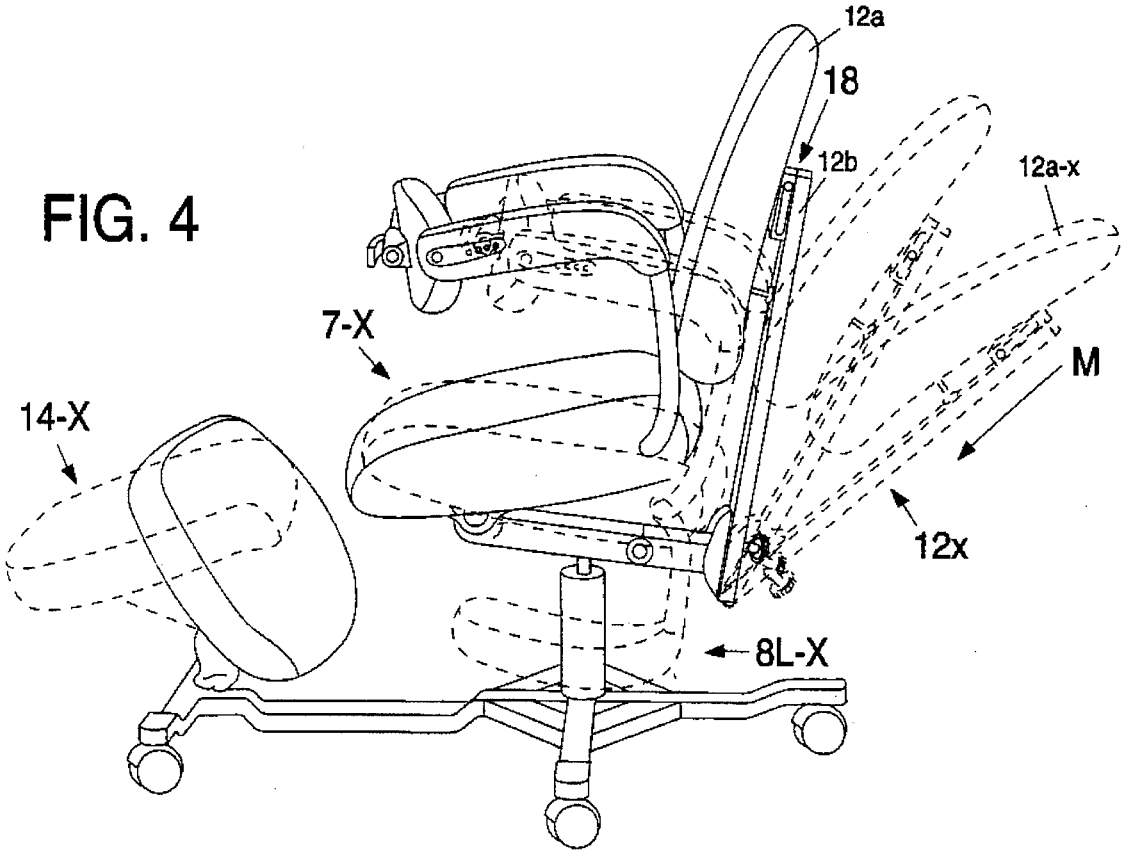

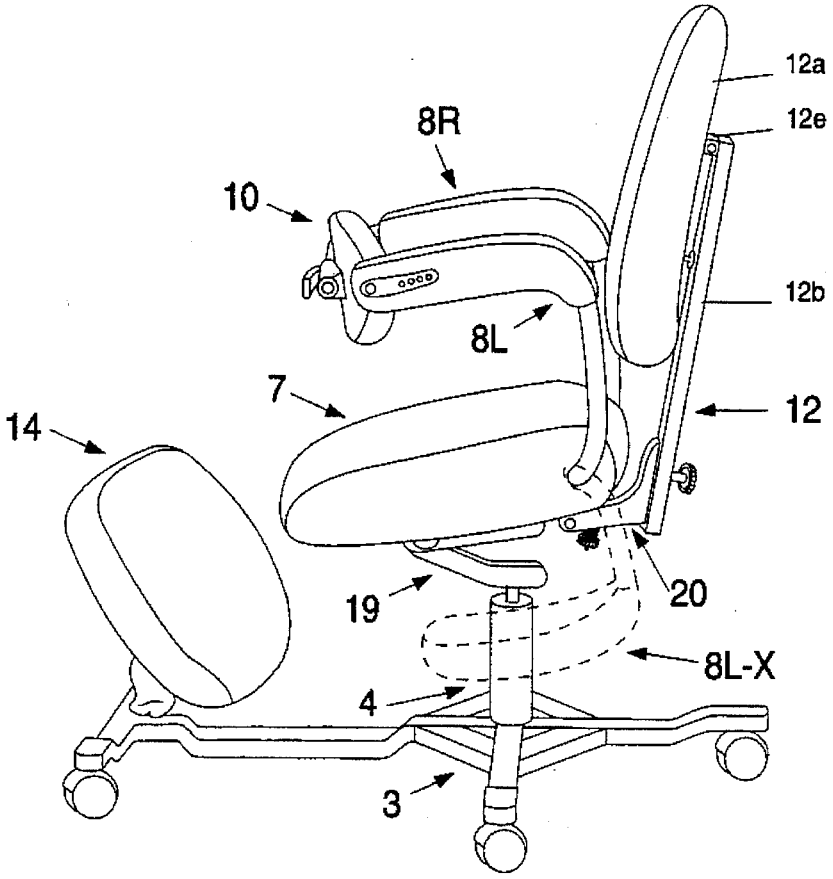
FIG. 5
FIG. 6
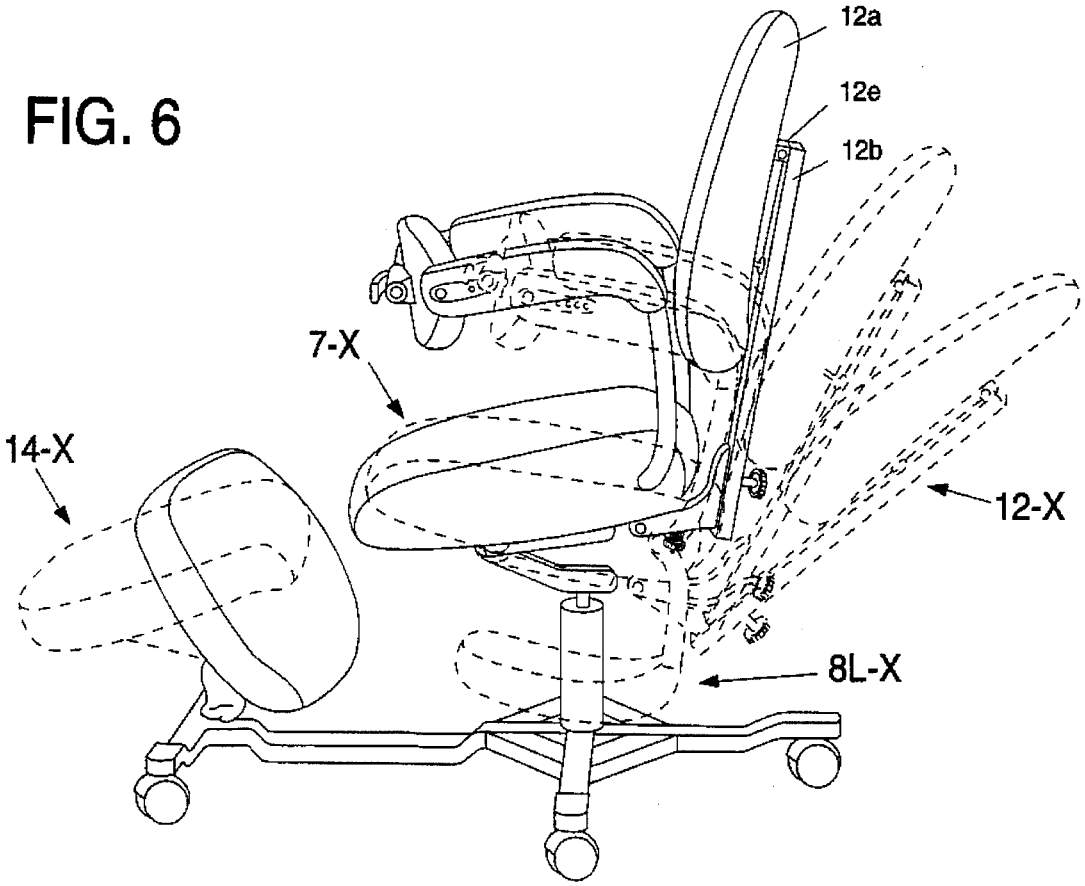

FIG. 35
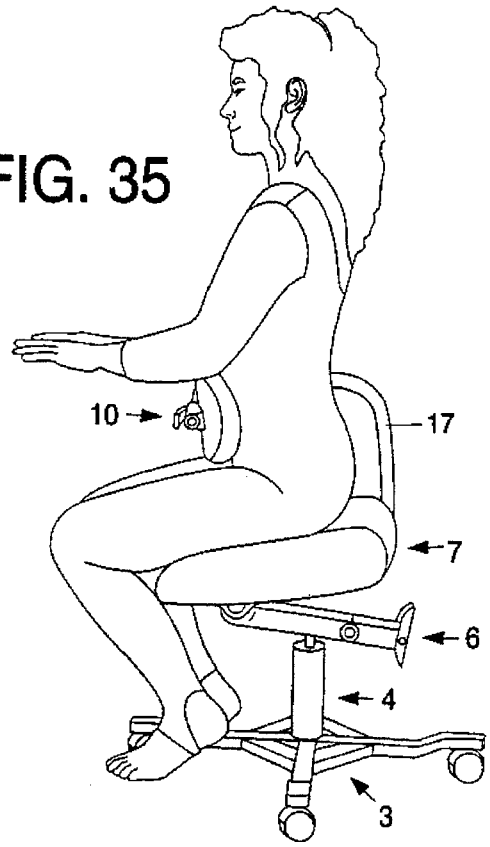
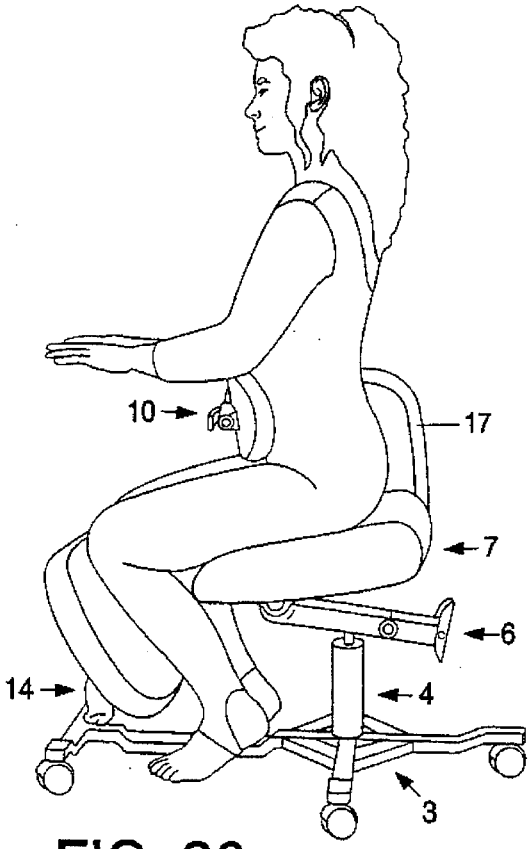
FIG. 36
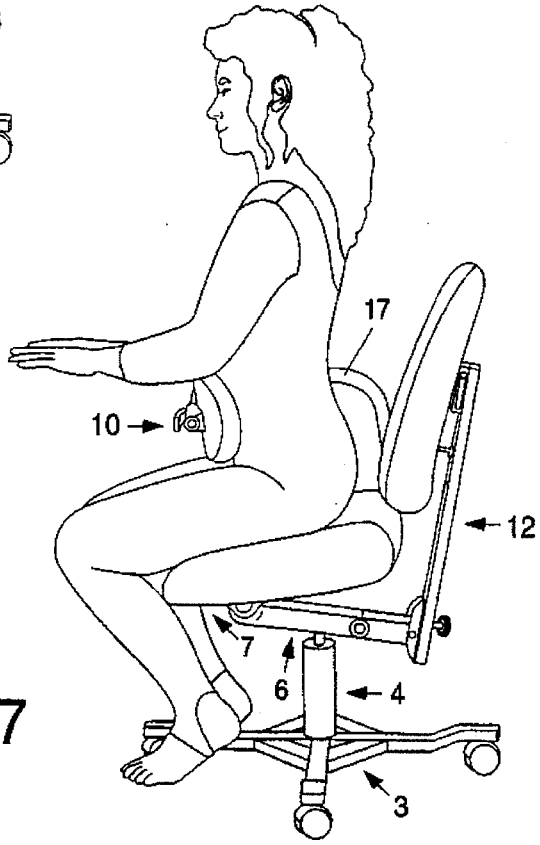
FIG. 37

FIG. 38
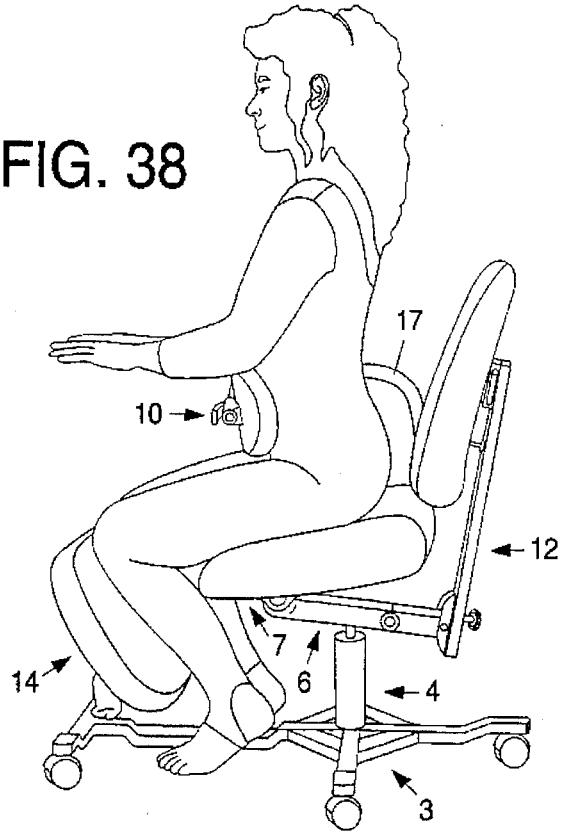
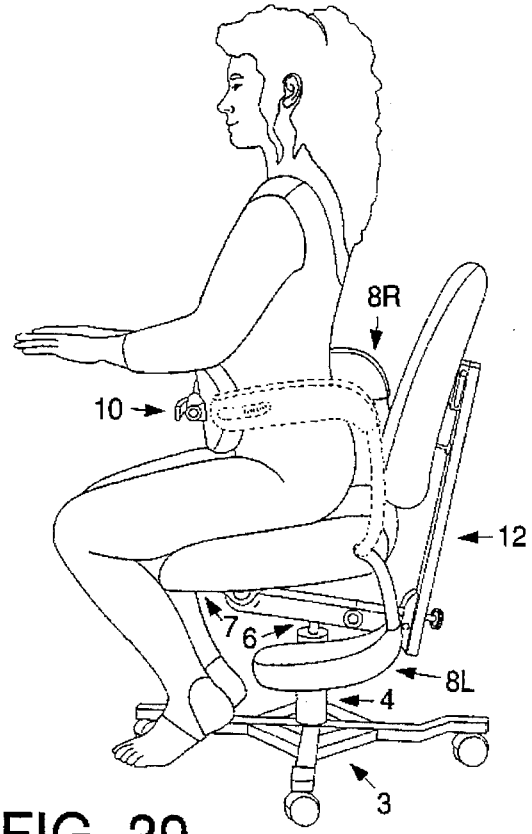
FIG. 39
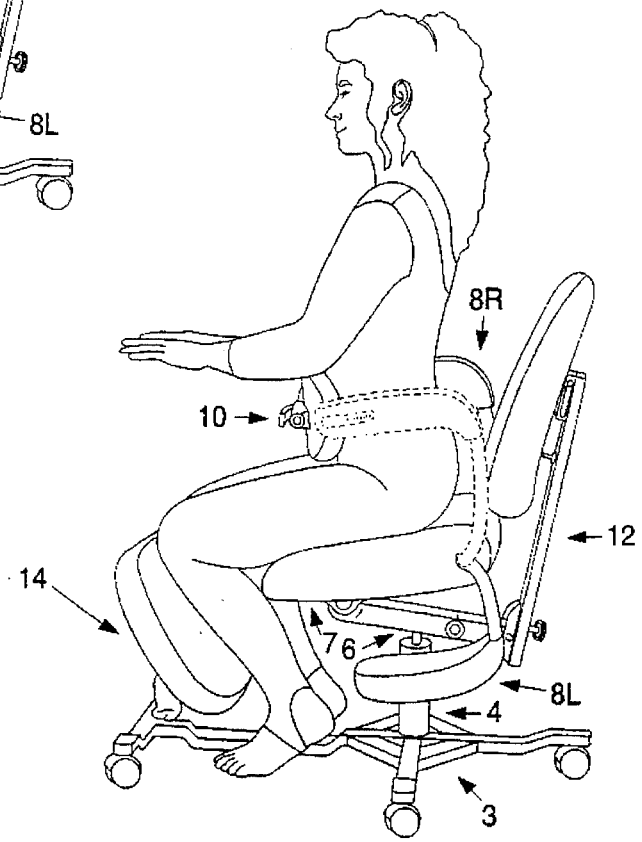
FIG. 40

VARIABLE POSTURE COMPONENT SYSTEM SEATING DEVICE

BACKGROUND

1. Field of Invention

The present invention relates to a variable posture work chair, particularly a component system in use at, or designed to function as, an office, industrial, or home work station.

2. Description of Prior Art

A widespread crisis in the physical aspect of sitting at the modern work station has initiated a variety of so-called ergonomic attempts to solve the problem. Briefly stated, that problem arises out of improper seating posture and the extended immobilization that is required of a worker at a work station, particularly where a keyboard is in use. Worker pain usually manifests itself in the lower back, the legs, the neck, the shoulders and the wrists. Much, although not all, of this pain can be attributed to poorly designed chairs that do not allow the sitter to effect real and meaningful changes in the long term sitting position.

Efforts to solve the problem from the standpoint of seating at the work station can be loosely grouped into five broad categories: conventional office chairs, kneeling posture chairs, forward support chairs, variable posture chairs and dedicated personal work stations. We shall omit from this discussion stools and associated designs that support a person in a standing or near standing position.

"Conventional office chairs" are what we are mostly accustomed to, comprising a base, a seat, a backrest, appropriate mechanisms and, in some cases, rests for the head and arms. Depending upon the design variation, the seat and the backrest may be solidly connected to act as a unit or they may move and/or be adjusted somewhat independently of one another. U.S. Pat. No. 5,056,866 to Tobler shows a conventional office chair incorporating another possible design feature, that of a rocker; Tobler builds his seat and back as a solid unit. It should be noted that the rocker principle can also be used in the above design of independent back and seat movement.

Most office chairs sold are of the conventional variety, improvements to which focus mainly on more and better chair adjustments, better seat design, and provision for lumbar support. The intrinsic drawback here is that the sitter is limited to minor variations on one basic sitting position, that of leaning backward; when the worker leans forward and into his or her work, as most people do, they come into opposition to the chair's basic design, eventually stressing the entire body. In such a chair one typically sits up or forward on the seat for brief periods of time, periodically collapsing against the chair's backrest for relief. Long term sitters resort to unconscious fidgeting, a sign the body is seeking a new position. Even those variations that allow the seat to tilt forward to accommodate the shifted pelvis are extremely limited because they do not provide support for the forward leaning body.

"Kneeling posture chairs" are a group of chairs that typically have a forward tilted seat, an oppositely tilted knee rest(s), and may be mounted on a variety of bases. U.S. Pat. No. 4,328,991 to Mengshoel and Opsvik, U.S. Pat. No. 4,589,699 to Dungan, and U.S. Pat. No. 4,767,159 to Opsvik are examples of this type of seating arrangement. While these chairs offer some improvement by emphasizing a forward tilted pelvis and an erect spine, they have several major drawbacks. First, because of the inclined seat angle and gravitational forces the sitter tends to slide forward and off of the seat, being prevented from doing so only by the knee rest. This design inherently focuses constant pressure directly on the knees, resulting in intolerable pain for many people. Second, while a desirable and ergonomically correct sitting posture would involve relaxing the legs while spreading out any support pressure on them evenly from the knee to the ankle, this inherently focused knee pressure makes such posture impossible. Third, while the design is supposed to promote good posture without upper body support it works only marginally in practice. A person at a work station does not sit eternally erect; one is constantly leaning forward, backward and to the sides, placing stress on the very muscles which maintain erect posture. As these muscles fatigue the sitter begins to slump and the posture actually deteriorates. Fourth, while the basic posture these chairs create is a good starting place, it is the only one they offer; immobility and constriction are serious problems with these chairs and many people abandon them after a few months of use. (One configuration shown in U.S. Pat. No. 4,328,991 does include a backrest and rails to allow a rocking motion; this chair will be mentioned again below as a variable posture design.)

"Forward support chairs" represent an attempt to solve a fundamental problem in work place sitting: that of accommodating the forward lean of the body. U.S. Pat. Nos. 4,650,249 to Serber and 4,943,117 to Brown show non-reversible forward support while sitting; U.S. Pat. Nos. 3,165,314 to Clearman and Webster and 3,754,787 to Garber show additional non-reversible industrial applications of this principle. Supporting the forward lean has certain advantages, but the design is still limited to one basic seating posture; it is also subject to certain of the criticisms of the reversible chairs below.

"Variable posture chairs" are here considered to be any chair that can support at least two distinct changes in body position. The significant advantage of this approach is that the sitter is allowed a complete posture change. We will form two subcategories in this group: reversible chairs and hybrids. Reversible chairs are chairs that can function in a conventional fashion and also be turned around to offer forward support. U.S. Pat. Nos. 454,100 to Wilson, 2,364,050 to Benson, 4,607,882 to Opsvik, and 4,832,407 to Serber show true reversible chairs, wherein the sitter may lean either forward or backward against a vertical plane of support. Variations of this and the aforementioned forward support principles can offer significant advantages at the work station; however, with the possible exception of the dedicated industrial designs all of these chairs also have significant drawbacks. First, since an adequate backrest must be large enough to comfortably spread out the pressure on the rear of the rib cage, reversal offers a large torso/chest support by default rather than planned design, or it compromises both; second, reversal cannot adequately address the real structural and physiological differences between forward and backward leaning; third, it can be argued that abdominal support is, in many cases, a preferable method of forward support; fourth, the torso support is mounted on a center post that comes up directly between the legs; therefore, they must be straddled to get into, and fifth, in the case of the reversible designs a sitter must get up and out of the chair, physically reverse it, and sit back down again to gain the benefit of that design.

These factors make the design singularly unattractive for many people to use in an office environment, and impossible for a woman wearing a dress. The center post mounting of the torso support is a particular nuisance. Several of these design issues also make it extremely difficult for those who may need help the most—the injured and the infirm—to enjoy its benefits.

Hybrids include any variable posture chair not already mentioned. Such chairs generally offer some knee/leg support in the form of a cushioned rest mounted to the chair base of a design that includes a seat and a backrest; the familiar recliner design would be part of this category. In U.S. Pat. No. 4,832,407 Serber has attached a knee rest to the center post of a traditional five star chair base via an extended member; only Serber offers optional forward support within this group. In U.S. Pat. No. 4,765,684 to Kvalheim and Petersen a knee rest is mounted to the center post of a conventional chair base via an extended member which allows it to be folded up and out of the way. In U.S. Pat. No. 5,054,857 to Kvalheim the back of a conventional chair may be folded down to become a knee rest, yielding a kneeling posture design. In U.S. Pat. No. 4,767,160 to Mengshoel a knee rest is mounted onto the tips of a five star base as an optional extension for a conventional chair. A somewhat different arrangement is shown in U.S. Pat. No. 5,255,957 to Opsvik and Mengshoel. As noted, Mengshoel and Opsvik also suggest a hybrid in U.S. Pat. No. 4,328,991, allowing the user of a kneeling posture chair to lean back in a conventional fashion and create a rocking motion. In U.S. Pat. No. 5,186,519 to Larson conventional and kneeling postures are suggested.

A major disadvantage to U.S. Pat. Nos. 4,832,407, 4,765,684 and 5,054,857 is that the extended member used to mount the knee/leg rest juts out directly between the legs, thus posing an eternal obstruction for the sitter's legs and feet; additionally, such a design approach does not provide for maximum chair stability. In U.S. Pat. Nos. 4,767,160 and 5,255,957 the leg obstruction is marginally lessened and stability increased, but in both cases an undue amount of non-integrated hardware is employed to stabilize a traditional five star base. In U.S. Pat. No. 5,255,957 Opsvik further suggests limited variable posture by employing a unique system of additional hardware; both Opsvik and Mengshoel show designs utilizing a solidly connected back-seat-armrest configuration. U.S. Pat. No. 4,328,991 is basically a variation on the kneeling posture design. In U.S. Pat. No. 5,186,519 Larson attains leg clearance and stability, but at a price of hardware and mechanization. Larson also shows variable posture by turning a seat into a backrest, but as with the reversible chairs the sitter must arise and change position to gain the benefit of the design.

"Dedicated personal work stations" are, in general, seating arrangements resembling a school desk designed to accommodate the worker and the personal computer. U.S. Pat. Nos. 4,880,270 to Cooper, 4,925,240 to Peters, 5,022,706 to Bryan, 5,054,852 to Tholkes and 5,056,864 to Cooper are examples of this approach; 4,767,159 to Opsvik shows an auxiliary desk mounted to the knee rest of a kneeling posture chair; U.S. Pat. No. 5,169,210 to Fricano shows a keyboard desk mounted to the center post of a conventional chair.

All of these examples but U.S. Pat. Nos. 4,767,159 and 5,169,210 are, by definition, dedicated stand alone designs. While this approach certainly has some merit it prevents the design from being used with a larger free standing work station, a definite commercial drawback. And while a proper design approach would integrate true variable posture for the worker into a keyboard work station, only Cooper's imaginative U.S. Pat. Nos. 4,880,270 and 5,056,864 really attempt to do this. Clearly, the design awaits further development.

The evolving demands of the modern work station overwhelm the human body. Days grow into months and years of sitting; the body grows, ages, changes, gets sick, injured or pregnant, and, above all, tires of sitting in the same position. The fact that the conventional chair is the most successful and widely used design in the world today should not obscure its increasingly obvious limitations. Looking elsewhere, all of the alternative designs mentioned above offer certain improvements but only as parts of the puzzle; individually they fail to provide a complete solution. What is needed is a simple, user friendly design that improves upon and integrates all of these elements—and some new ones—into a new, synergistic seating device, preferably one that can be built, marketed and used as a component system.

OBJECTS AND ADVANTAGES

In general,

To provide a completely integrated, variable posture component system seating device, or work chair, which may be configured to a variety of individual sitter and work place requirements by allowing a user to select from a plurality of optional body support and work surface components; this system shall be of a design which incorporates, improves upon and adds to elements of the conventional, kneeling posture, forward support, variable posture and personal work station designs, yielding a new, synergistic design with commercial applications in the home, office, and industrial work place.

Several specific objects and advantages of my invention are as follows:

One object is to provide a variable posture work chair in which components may be easily added, removed, adjusted and displaced so that

- a user may configure the chair in light of specific physical requirements such as age, infirmity, injury, pregnancy, and disability, and
- a wide variety of work place requirements may be met.

A further object is to provide a variable posture work chair in which an abdominal rest may be used in conjunction with a back rest,

- this allowing both fore and aft leaning support to be provided from a single sitting position, eliminating the need for chair reversal to gain such support, and
- fore or aft leaning support may be made available exclusive of one another by removing one of the supports.

A further object is to provide a variable posture work chair that provides support over the entire range of fore and aft leaning normally associated with human sitting by utilizing planes of body support that move and adjust independently of one another,

- this constituting variable posture and bringing relief to a sitter confined to a work station for extended periods of time,
- and which specifically allows a sitter to move smoothly through three supported postures involving a center of gravity change without having to change or adjust the chair.

A further object is to provide a variable posture work chair with a seat that tilts on an axis over a range of about ±20 degrees from the horizontal, which can effect a rocking motion, and which defaults to a generally forward tilt position:

- this range of tilt allowing the seat to passively accommodate the fore and aft leaning positions of a seated user;
- the rocking motions enhancing the benefits of variable posture and enabling easy movement between fore and aft support positions, and the forward tilt position facilitating entry into and exit from the chair for both the healthy and the infirm, particularly when combined with a tension actuated back rest.

A further object is to provide a variable posture work chair in which a variety of work surfaces, including a keyboard desk, may be used in conjunction with planes of body support, this enabling a user to operate a device such as a keyboard while enjoying the benefits of variable posture, and this also allowing the chair to be specifically configured to diverse needs, such as those of a computer operator and a lab worker.

A further object is to provide a variable posture work chair with two arm rests, either of which may provide mounting points for an abdominal rest or a work surface such as a keyboard desk:

this minimizing the need for additional hardware when creating mounts for such accessories, thereby streamlining chair design and construction while minimizing costs, and providing maximum leg clearance and ease of entry and exit to the user of such a chair by creating a generally horizontal mount for such accessories, and enabling and maintaining precise alignment between the arm rests and the keyboard desk, thereby simplifying operations for a user, and maintaining a consistent spatial relationship between the keyboard and a user's arms and upper body, particularly when a rocking motion or change in body position is being effected.

A further object is to provide a variable posture work chair in which the arm rests may be easily moved between positions of use and nonuse, this allowing for a plurality of arm rest configurations keyed to the nature of specific tasks.

A further object is to provide a variable posture work chair utilizing a combination knee/leg rest which:

may be used in conjunction with an abdominal rest that absorbs most of the forward leaning pressure, thereby allowing even, variable pressure on the legs of a seated user when the rest is used in a kneeling configuration, and which may easily be moved to support a seated user's reclining position, and which may be placed in a horizontal orientation to provide a supplemental work surface, the chair remaining functional when turned away from the rest.

A further object is to provide a variable posture work chair that may, as a primary option, be mounted on an elongated low profile base of single unit construction, with the following advantages:

the overall length and width of the assembled members provides excellent functional stability to the assemblies mounted thereon, and the counterbalancing effect of the opposing assemblies increases the stability, and the specified low profile construction creates a base that is mostly unobtrusive, providing maximum leg and foot clearance for a user entering, exiting, and rotating in the chair, and the design of the base allows a user to orient the knee/leg rest toward the primary work location, periodically rotating the chair assembly away from the rest to free the legs for stretching or to use the chair in a conventional fashion, and the design of the base allows for the mounting of a separate work surface assembly.

Further objects and advantages of my invention will become apparent from a consideration of the drawings and ensuing description.

DESCRIPTION OF DRAWINGS

While the present number of drawings may seem large, the purpose is to illustrate how the components of the present variable posture component system seating device can be configured to meet a wide range of individual sitter and work place requirements.

FIGS. 3 & 4 show the approximate movements of the work chair planes of body support in the preferred embodiment, where the backrest is mounted to the seat adjustment mechanism independent of the seat;

FIGS. 5 & 6 show the approximate movements of the work chair planes of body support in an alternative embodiment, where the backrest is moveably mounted to the seat assembly;

FIGS. 35 through 40 show how a sitter can maintain a balanced state of equilibrium by employing one or more available planes of body support.

REFERENCE NUMERALS IN DRAWINGS

Figure 1:
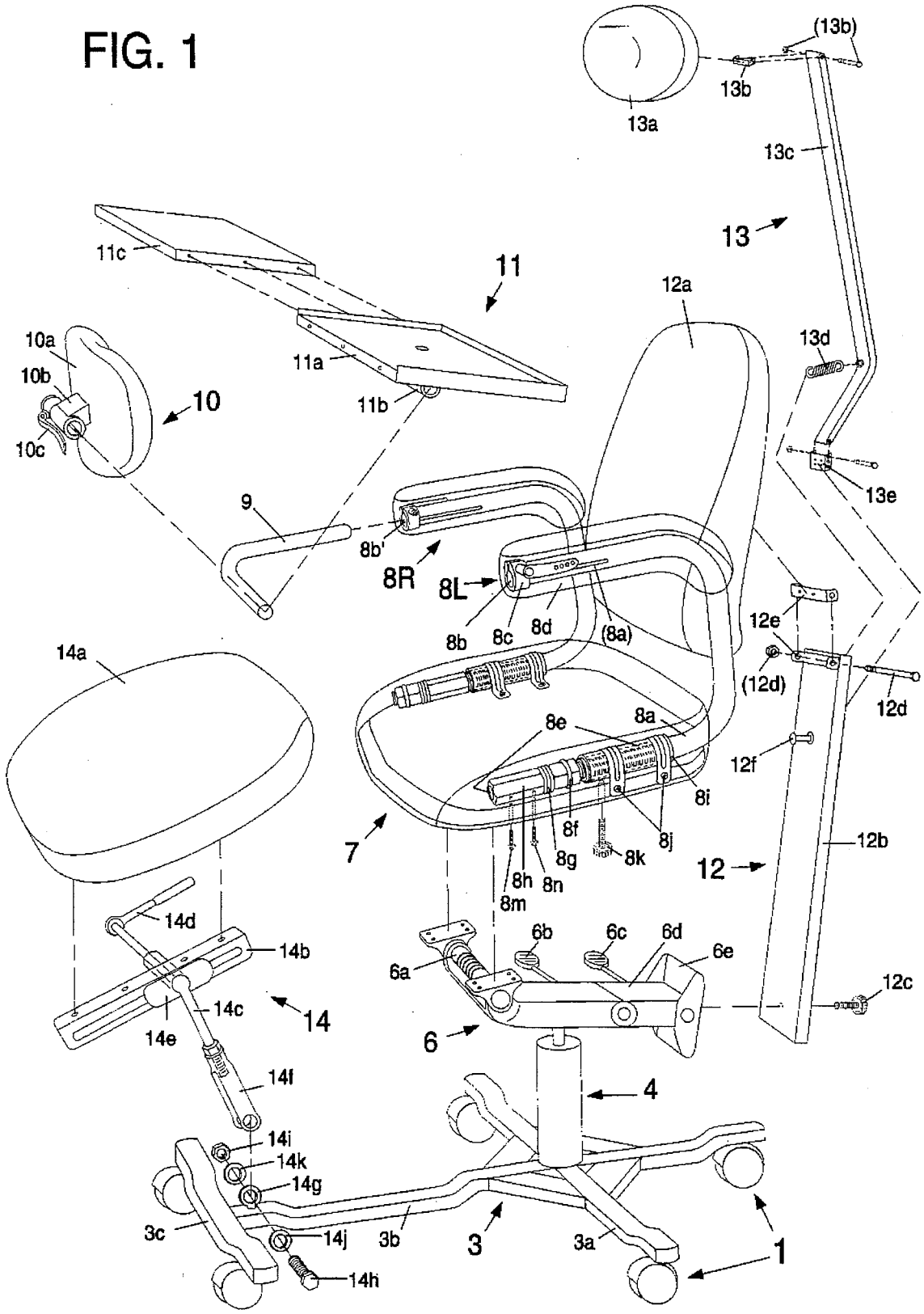
FIG. 1 is a partially exploded reference view of the work chair with most of the main parts illustrated and numbered.

FIGS. 1–40 refer to individual drawings.

A1 through E4 refer to various system configurations, wherein series "A" refers to free standing work stations;

series "B" refers to hybrid work stations, usable alone or in conjunction with a secondary work station;

series "C" refers to a variable posture chair, usable alone or in conjunction with a work station;

series "D" shows the chair on a four point low profile base of normal and elevated heights;

series "E" refers to certain industrial configurations.

Numbers 1 through 20 and upper case letters refer to assemblies and individual chair parts; numbers with lower case letters (i.e., 8*g*) indicate components of an assembly.

| | Components and Assemblies |
|---|---|
| 1. | Casters |
| 2. | Short Base Assembly |
| 2a. | Cross member |
| 2b. | Cross member |
| 3. | Long Base Assembly |
| 3a. | Cross member |
| 3b. | Main member |
| 3c. | Short member |
| 4. | Height Adjustment Mechanism |
| 4'. | Elongated Height Adjustment Mechanism |
| 5. | 360 Degree Foot Rest |
| 6. | Seat Adjustment Mechanism |
| 6a. | Spring loaded mount |
| 6b,c. | Control levers |
| 6d. | Housing |
| 6e. | Backrest support post mounting plate |
| 7. | Seat Assembly |
| 7-X. | Phantom seat assembly position |
| 8R. | Right Armrest Assembly |
| 8L. | Left Armrest Assembly |
| 8a. | Main member |
| 8b. | Mounting hole |
| 8b'. | Mounting hole |
| 8c. | Compression clamp assembly |
| 8d. | Armrest pad |
| 8e. | Threaded shaft |
| 8f. | Lock nuts/washers |
| 8g. | Spring Washers |
| 8h. | Coupling nut |
| 8i. | Sleeve |
| 8j. | Clamps |
| 8k. | Locking screw |
| 8m. | Bolt |
| 8n. | Bolt |
| 8L-X. | Phantom armrest position |
| 9. | Accessory Support Bar |
| 10. | Abdominal Rest Assembly |
| 10a. | Abdominal rest |
| 10b. | Mount |
| 10c. | Toggle clamp |
| 11. | Keyboard Desk Assembly |
| 11a. | Keyboard Desk |
| 11b. | Mount |
| 11c. | Auxiliary keyboard desk |
| 12. | Backrest Assembly |
| 12a. | Backrest cushion |
| 12a-x. | Phantom backrest cushion position |
| 12b. | Support post |
| 12c. | Tension knob |
| 12d. | Bolt and nut |
| 12e. | Hinge |
| 12f. | Vertical positioner |
| 12-X. | Phantom backrest assembly position |
| 13. | Headrest Assembly |
| 13a. | Headrest cushion |
| 13b. | Small hinge pin assembly |
| 13c. | Support Post |

-continued

| | Components and Assemblies |
|---|---|
| 13d. | Spring |
| 13e. | Large hingeh pin assembly |
| 14. | Knee/Leg Rest Assembly |
| 14a. | Knee/leg rest cushion |
| 14b. | mounting rail |
| 14c. | Threaded mounting post |
| 14d. | Ratcheting assembly |
| 14e. | Backing plate |
| 14f. | Yoke |
| 14g. | Eye bolt |
| 14h. | Bolt |
| 14i. | Locking nut |
| 14j. | Machine shim |
| 14k. | Machine shim |
| 14-X. | Phantom knee/leg rest position |
| 15. | Auxiliary Desk Assembly |
| 15a. | Main desk |
| 15b. | Auxiliary work surface |
| 15c. | Mounting rail |
| 15d. | Threaded mounting post |
| 15e. | Ratcheting assembly |
| 15f. | Backing plates |
| 15g. | Main support post |
| 15h. | Height adjustment knob |
| 15i. | Slotted cushion |
| 15j. | Left mounting rail |
| 15k. | Right mounting rail |
| 151. | Locking bolt |
| 15m. | Machine shim |
| 15n. | Machine shim |
| 15o. | Backing Plate |
| 15p. | Backing Plate |
| 15q. | Ratcheting assembly |
| 15r. | Eye bolt |
| 15s. | Bolt |
| 15t. | Lock nut |
| 15u. | Machine shim |
| 15v. | Machine shim |
| 16. | Horizontal Work Surfac |
| 16a. | Telescoping Post |
| 16b. | Tensioner Surface |
| 16c. | Horizontal work |
| 17. | Abdominal Rest Mounting Bar |
| 18. | Spring Loaded Pivot Assembly |
| 19. | Forward Pivot Control |
| 20 | Spring Hinge Assembly |
| M. | Direction of movement arrow |

SUMMARY OF THE INVENTION

The present invention is a variable posture work chair that might be loosely categorized as a hybrid. A key feature of its design is the ability to combine planes of body support with work surfaces. It is built to be sold as a component system with a wide variety of applications in the home, office and industrial work place.

DESCRIPTION OF INVENTION

The component nature of the chair's design enables a wide variety of configurations. FIG. 1 is a partially exploded view of the component system chair that may be used as a reference for many of the subsequent drawings. A low profile long base assembly 3 comprising a cross member 3*a*, a main member 3*b*, and a short member 3*c* is mounted onto five commercially available casters 1. A height adjustment mechanism 4, known in the prior art of either gas or mechanical operation, is mounted at the intersection of 3*a* and 3*b*. A seat adjustment mechanism 6 is mounted in a fashion which allows for 360 degree rotation; the mechanism comprises generally a spring loaded mount 6*a*, a plurality of control levers 6*b*, 6*c*, a housing for internal mechanisms 6*d* and a backrest support mounting plate 6*e*. In general the mechanism should have a user definable range of tilt of ±20 degrees from the horizontal, have a spring actuated forward tilt default position, and be designed to function with a free rocking action or to lock down at any point within its range of movement. In the preferred embodiment the mechanism would also provide an adjustable spring loaded mount for the backrest, allowing the backrest to move and be adjusted independently of the seat.

A seat assembly 7, comprising generally a platform, cushioning material and a cover, is mounted to 6. In the preferred embodiment two movable armrest assemblies, 8L and 8R, are mounted to the seat. These assemblies are identical except as noted below. In one embodiment (8L) a tubular metal main member 8*a* may be slit at one end to allow for compression; the open end of the tube provides for a mounting hole 8*b* (and 8*b*'). A compression clamp assembly 8*c*, is mounted generally at the compressible end of the main member or incorporated into its design. An armrest pad 8*d* generally comprising padding, backing and a cover of a variable size is mounted on the main member. A threaded shaft 8*e* is fixedly mounted inside main member 8*a* and passes through two interlocked lock nuts/washers 8*f*, one or more spring washers 8*g*, and a coupling nut 8*h*, which is bolted to seat 7 with bolts 8*m* and 8*n*. The assembled section of main member 8*a* and threaded shaft 8*e* is inserted freely into a smooth sleeve 8*i* which in turn is held down by clamps 8*j*. The resulting assembly may be rotated to a storage position under the seat or to an upright position halted by the compression of interlocked lock nuts/washers 8*f*, which are locked into place on threaded shaft 8*e*, against spring washers 8*g* and coupling nut 8*h*. The assembly may be locked into an upright position with locking screw 8*k* which passes through a hole in seat assembly 7 into a vertical shaft in the assembly of 8*e* and 8*a*.

While armrest assembly 8R is essentially identical to 8L, their movements must be mirrored. To allow for the use of an identically (right hand) threaded rod in both assemblies where opposing rotation is required the positions of 8*f*, 8*g*, and 8*h* are reversed in assembly 8R.

An accessory support bar 9, which may be of a variety of designs and which may be integral with an accessory, may be inserted into mounting holes 8*b* or 8*b*'. If used as a separate component the support bar may accept a plurality of accessories. An abdominal rest assembly 10 comprises generally a padded abdominal rest 10*a*, a mount 10*b*, and a toggle clamp 10*c* which slides via the mount onto the support bar and locks into position with the clamp. A keyboard desk assembly 11 comprises generally a keyboard desk 11*a*, a mount 11*b* that may be used to mount the keyboard desk 11*a* to the support bar 9 by means of a toggle clamp that is similar to the toggle clamp 10*c* used to attach the abdominal rest 10*a* to the support bar 9, and an auxiliary keyboard desk 11*c* which may be mounted on the side or the front of the keyboard desk 11*a*. The keyboard desk assembly slides onto the support bar and locks into place in the same fashion as does the abdominal rest assembly.

In the preferred embodiment a backrest assembly 12 attaches to seat adjustment mechanism 6. A backrest cushion 12*a*, comprising generally a platform, cushioning and a cover, mounts to support post 12*b* through the interconnection of assembled bolt 12*d* and nut 12*d* and hinge 12*e*. A vertical positioner 12*f* may be used to alter the vertical inclination of the backrest. A tension knob 12*c* locks the assembly into place against mounting plate 6*e*. An optional headrest assembly 13 may be attached to the backrest assembly. A headrest cushion 13*a*, comprising generally a platform, cushioning and a cover, is attached to support post 13*c* by means of a small hinge pin (13*b*) assembly. The support post 13*c* mounts onto support post 12*b* by means of a vertically adjustable large hinge pin assembly 13*e*; the assembly is held in place by a spring 13*d* which allows the assembly to flex backward as weight increases against the cushion.

A knee/leg rest assembly 14 is mounted at the forward end of the long base assembly 3 near the juncture of 3*b* and 3*c*. A knee/leg rest cushion 14*a*, comprising generally a platform, cushioning and a cover, is mounted onto a slotted mounting rail 14*b*. The mounting rail is mounted onto a threaded mounting post 14*c* which is held in place and released for adjustment by ratcheting assembly 14*d* and backing plates 14*e* on either side of the mounting rail. The lower end of the threaded mounting post is threaded into a yoke 14*f* which mates with an eye bolt 14*g* and is held in place with bolt 14*h* and locking nut 14*i* and machine shims 14*j* and 14*k*.

An alternative embodiment for this mounting arrangement utilizes levers, clutch plates, and spring compression in place of ratcheting assembly 14*d*, mounting rail 14*b*, and backing plate 14*e*.

Figure 2:
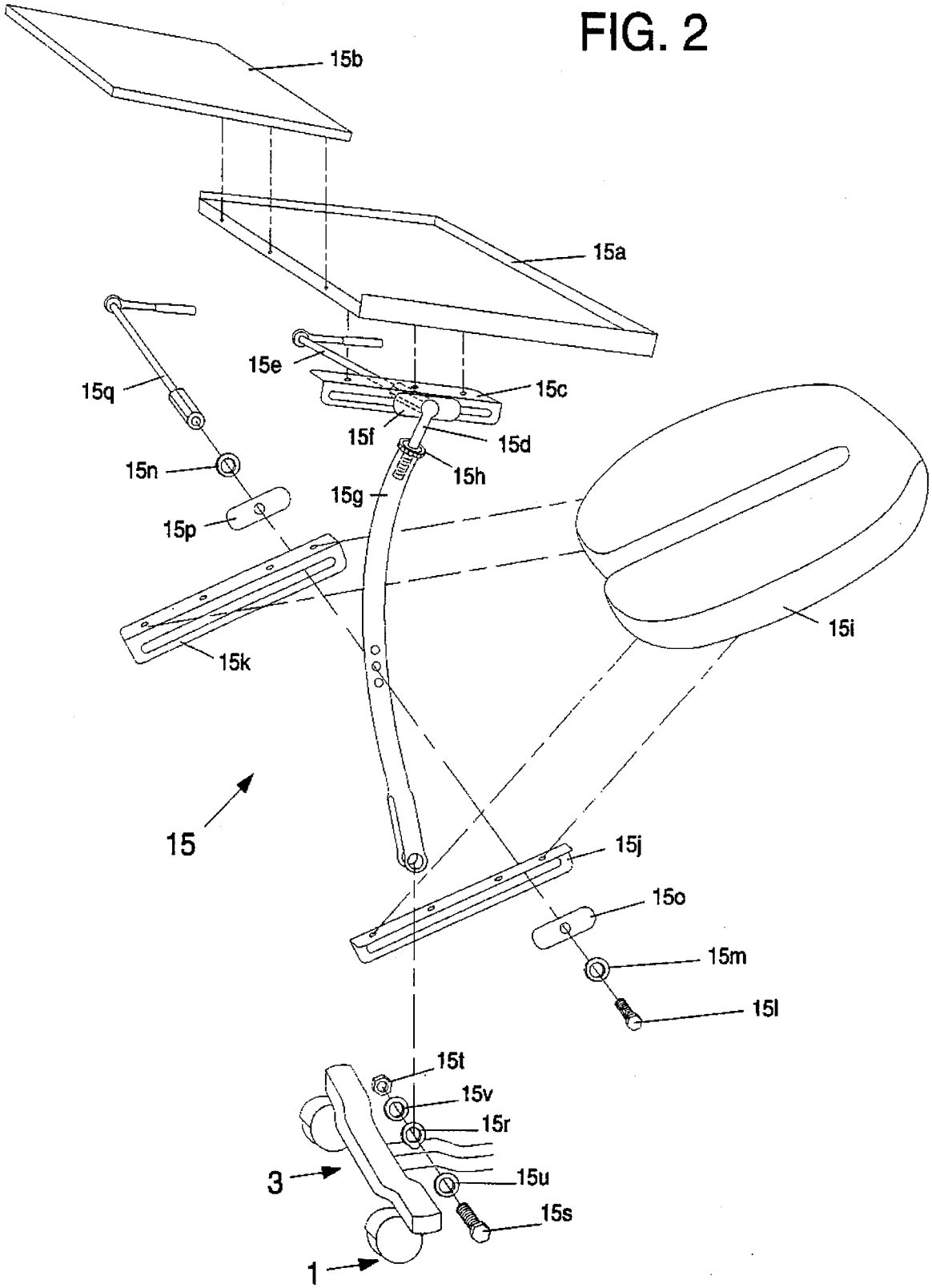
FIG. 2 is a partially exploded reference view of an auxiliary desk assembly.

FIG. 2 is a partially exploded view of an auxiliary desk assembly 15 that enables the work chair to be configured as a free standing work station. A main desk 15*a* to which an auxiliary work surface 15*b* may be attached, is attached to a slotted mounting rail 15*c*. The rail is mounted onto a threaded mounting post 15*d* and is held in place and released for adjustment by ratcheting assembly 15*e* and backing plates 15*f* on either side of the rail. Alternatively, levers, clutch plates, and spring compression could be employed in this mounting arrangement. The threaded mounting post 15*d* is slotted (not shown) or flattened on one side of its vertical inclination to prevent it from turning when inserted into a mated hole in the main support post 15*g*. The mounting post may be adjusted vertically by engaging its threads with a height adjustment knob 15*h*. A locking telescoping assembly wherein a shaft slides in and out of 15*g* is one possible alternative for the arrangement of 15*d*, 15*h*, and 15*g*. A slotted cushion 15*i*, comprising generally a platform, cushioning and a cover, mounts onto left and right slotted mounting rails 15*j* and 15*k*; the assembled pieces are mounted onto the main support post at the point of a hole and held in place by a bolt 151, machine shims 15*m* and 15*n*, backing plates 15*o* and 15*p* and a ratcheting assembly 15*q*. The auxiliary desk assembly mounts onto the forward end of long base assembly 3 near the junction of 3*b* and 3*c*. The yoked end of the main support post 15*g* mates with an eye bolt 15*r* and is held in place with bolt 15*s* and locking nut 15*t* and machine shims 15*u* and 15*v*.

FIG. 3 shows a profile of the assembly of FIG. 1 in the preferred embodiment, minus the optional headrest assembly 13. A spring loaded pivot assembly 18 has been substituted for hinge 12*e*. In the preferred embodiment backrest assembly 12 and seat assembly 7 are mounted to seat adjustment mechanism 6. Armrest assemblies 8L and 8R are designed to swing down as shown by the phantom armrest position of 8L-X.

In FIG. 4 the user has manually tilted knee/leg rest assembly 14 to the forward position of phantom 14-X to accommodate the calves of his or her outstretched legs. If the sitter chooses to recline in this configuration seat assembly 7 will tilt back to phantom position 7-X. Assemblies and components 8L, 8R, and 10 are mounted to the seat and change position with it. One or both of the armrest assemblies may be folded under the seat during this change of position as illustrated by phantom position 8L-X. Backrest assembly 12 will tilt back to the approximate position shown by 12-X under the weight of a sitter. Backrest cushion 12*a*, mounted onto support post 12*b* by means of spring loaded pivot assembly 18, will move downward relative to the support post (as shown by arrow M) to phantom position 12*a–x* as the relative positions of seat 7 and backrest cushion 12*a* grow further apart during the tilting movement. This prevents the backrest cushion from pushing upward on a sitter's shirt or coat as he or she leans backward, a problem known in the office seating industry as "shirt pull".

FIG. 5 shows an alternative embodiment similar to the assembly of FIG. 1. Seat assembly 7 is mounted on forward pivot control 19, an assembly known in the prior art. Backrest assembly 12 is mounted onto the seat assembly by means of spring hinge assembly 20, thus allowing for the approximate motion of the planes of body support shown in FIG. 6. The relative change in position of the backrest and seat during tilting is not as great here as in the prior illustrations of FIGS. 3 and 4. In this embodiment backrest cushion 12*a* is mounted to support post 12*b* by a simple pivot hinge 12*e* since the effect of shirt pull is not as pronounced in this configuration; nonetheless the means of mounting the cushion to the post is optional.

Figure 22:
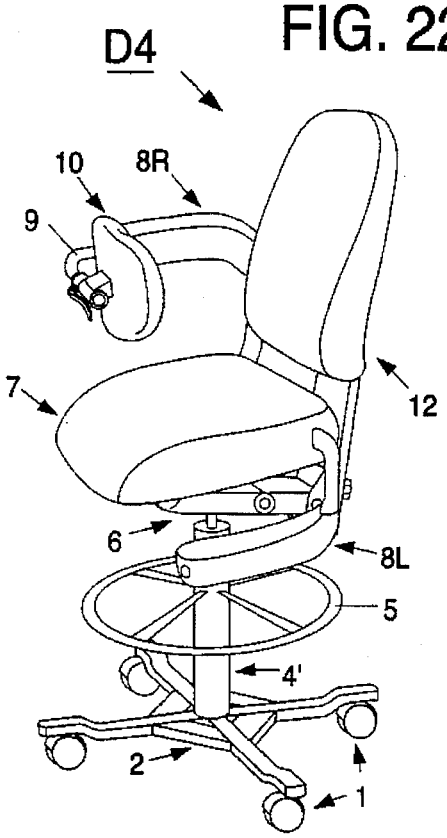
FIG. 22 shows an embodiment of the work chair on an elevated four point base.

FIGS. 7 through 18 (series A, B, and C) show various assembled configurations of the work chair using the elements described in FIGS. 1 and 2. In FIGS. 19 through 22 (series D) the work chair is mounted on a low profile (four point) short base assembly 2, comprising cross members 2*a* and 2*b*, mounted on four casters 1 (a conventional five point base may also be used). In FIG. 22 an elongated height adjustment mechanism 4' allows the chair assembly to be used at an elevated work station. A 360 degree foot rest 5 has been attached to the exterior housing of 4'. Other illustrations in series "D" are further configurations of previously described assemblies and parts.

Figure 23:
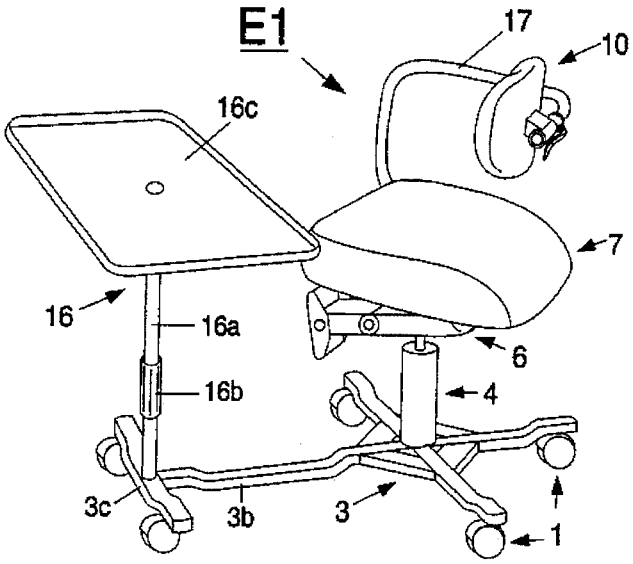
FIGS. 23, 24, 25 and 26 show various industrial applications of the work chair.

FIGS. 23 through 26 (series E) show possible industrial configurations of the work chair. In FIG. 23 previously described assemblies and parts 1, 3, 4, 6, 7, and 10 are utilized; abdominal rest assembly 10 is held in place by an abdominal rest mounting bar 17 which is fixedly attached to seat assembly 7. A horizontal work surface assembly 16 is fixedly attached to the forward end of long base assembly 3; a telescoping post of known design 16*a*, the vertical extension of which may be fixed by a grip tensioner 16*b*, is mounted near the junction of 3*b* and 3*c*. A horizontal work surface 16*c* is attached to the top of the post. Other illustrations in series "E" are further configurations of previously described assemblies and parts.

The object of building the present invention is to provide for a fully adjustable, variable posture work chair that can easily integrate optional work surfaces into its design. Anticipated configurations and designs for assemblies and parts are not limited to those shown. Some possible variations:

the armrest assemblies are designed to be fully functional supports for the arms while providing a mounting point for accessories such as work surfaces and an abdominal rest. They may rotate or swing in directions other than those described; they may employ a plurality of points of adjustment and/or rotation; they may employ designs using cams, springs and other locking/release devices which allow them to be rotated up, down, and locked into place in the most efficient manner possible; and, in certain configurations, the armrests may be solidly fixed;

the armrest pads may be significantly larger than shown;

the accessory support bar may be shaped in a variety of ways, may employ a hinged elbow which allows it to be adjusted, locked in place and folded out of the way, and may be integrated into an accessory to form a single assembly;

means for mounting accessories onto the armrests are not limited to those illustrated. The support bar may employ splines or facets on the section of its shaft which inserts into a mated female armrest assembly, and alternative hinging and mounting means may be mounted to any point of the armrests;

the abdominal rest may be enlarged and/or shaped to also serve as an armrest, and a forward armrest or special use body support may be used in place of an abdominal rest;

the abdominal rest may be mounted from a forward mount, such as the main support post 15*g* in the auxiliary desk assembly;

any number of main and auxiliary desk assemblies may be mounted and configured to accommodate the needs of a worker, be those needs related to the use of a computerized system or any other type of activity;

alternative mechanisms for controlling the knee/leg rest and auxiliary desk may utilize prior art clutch plates, springs and tension release levers to control the adjustment of those components;

cushioned planes of body support may be motorized to provide for vibration or other forms of muscle massage;

in general: accessories, mechanisms and supporting posts/structures may be redesigned, and/or integrated into single units, as the need arises.

OPERATION OF INVENTION

A sitter determines how best to configure and operate the work chair by analyzing the demands of a particular work place application in light of his or her specific physical needs. Most seated tasks demand a certain amount of fore and aft leaning; some require mobility in the form of frequently rising from and resettling into the seat, or propelling oneself around the floor while remaining seated (as from a desk to a filing cabinet); still others, such as any task with a computer, require that a person maintain a relatively stable and immobile position for extended periods of time. The use of this invention makes it possible to balance the demands of any seated task with the realities of a sitter's age, physical condition, physique and the general ability to tolerate certain sitting positions over others. In addition it provides the sitter with the critical ability to change position completely and easily, as the need arises.

It is anticipated that most of the use for the work chair will center around configurations from series A (freestanding work stations), B (hybrid work stations), and C (variable posture chairs), represented by FIGS. 7 through 18 and detailed in FIGS. 1 and 2. Some of that use is further illustrated in FIGS. 27 through 40.

Figure 27:
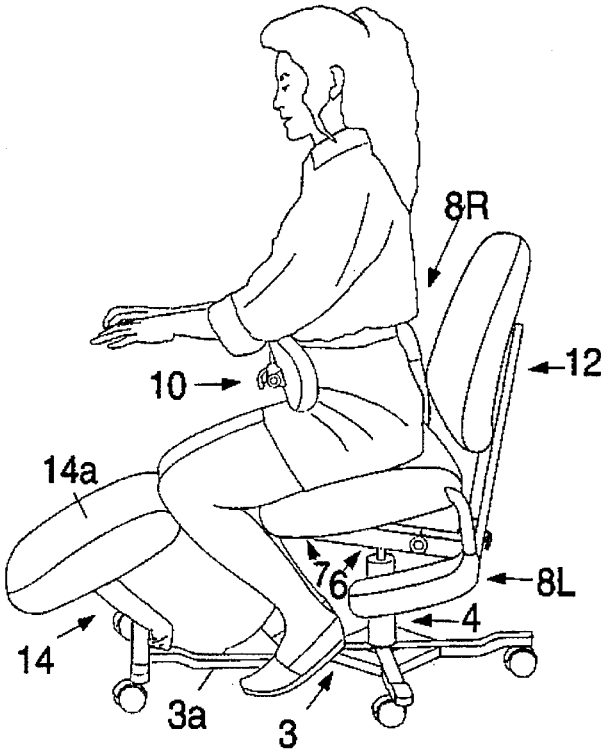
FIGS. 27, 28, and 29 show the sequence of continuously variable configuration.
Figure 28:
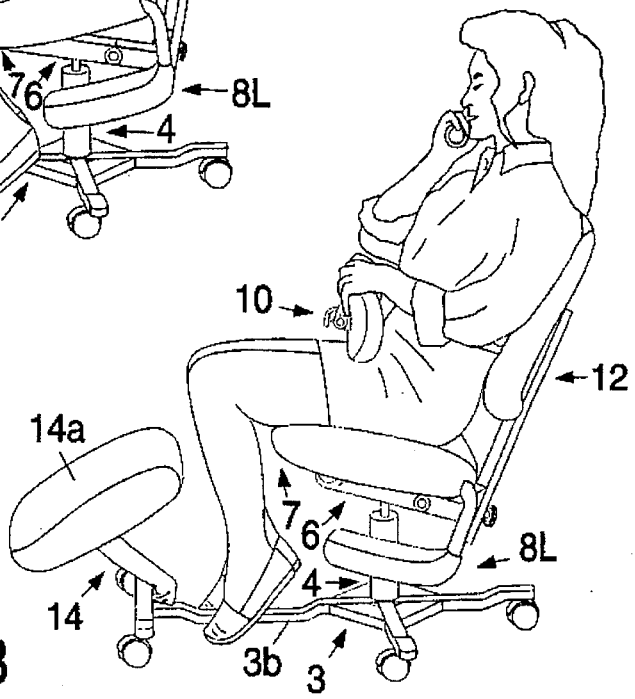
Figure 29:
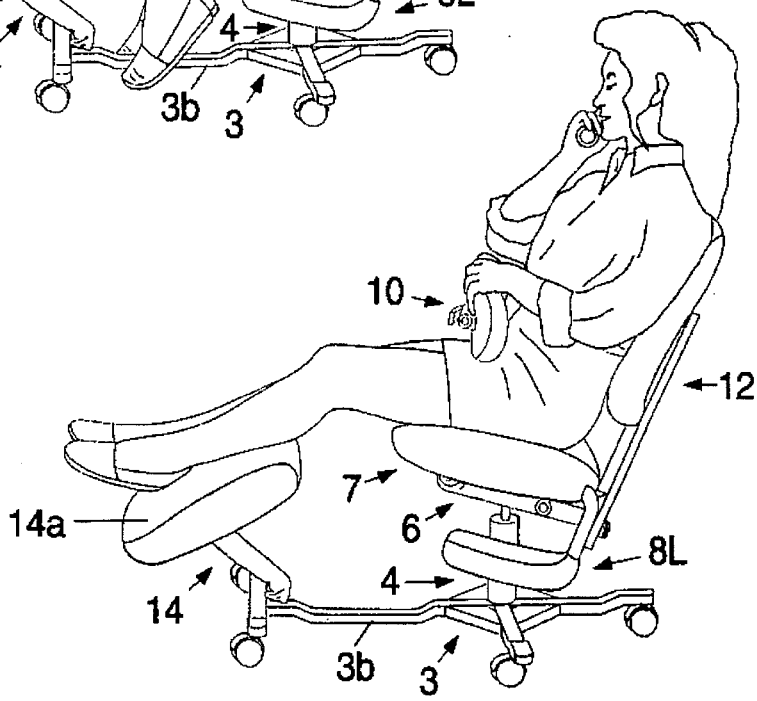

An example of how a busy worker might benefit from the chair's design is shown in FIGS. 27–29. Because this worker is constantly getting up and down and performing a variety of activities these illustrations show what might be called the task configuration, one which provides a good range of support while allowing for quick entry and exit. In addition, the arrangement and interconnection of the chair's planes of body support allow for an easy and complete change of body position, here called continuously variable posture. The advantages of using the low profile long base assembly 3 are readily apparent in these illustrations. By mounting the knee/leg rest assembly 14 on a pivot point at the forward end of the low profile base maximum foot and leg clearances are achieved. The elongated low profile main member **3*b* is only about eight inches longer than the standard spider or five point chair base design, thus occupying only slightly more forward space than a user's legs; when the knee/leg rest is tilted forward as illustrated the entire assembly requires only about 12–15 inches of space under a desk, workable in all but the most impossibly cramped of spaces (see also FIGS. 30 & 31**). The base design also provides extraordinary stability for the entire assembly. Because of the elongated forward member it is impossible to tip the chair over when leaning forward. The knee/leg rest assembly becomes an effective counterweight to the forward lean when the chair seat is rotated 180 degrees away from it. In practice, the chair is quite stable no matter which direction the seat is oriented in as long as a user does not abuse it.

Figure 30:
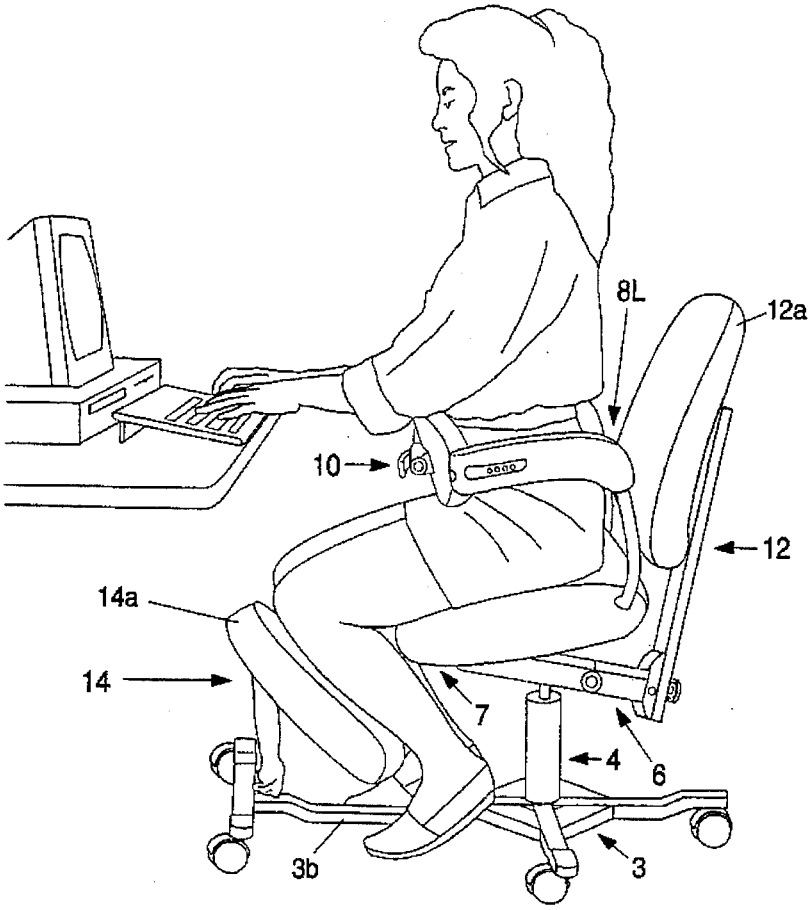
FIGS. 30 and 31 show two possible uses of the work chair with a detached work station.

In FIG. 27 the worker is engaged in a task requiring that she lean slightly forward, in this case working at a keyboard on a detached desk (see also FIG. 30). She is seated on seat assembly 7 which is tilted forward to an angle pre-adjusted by spring actuated seat adjustment mechanism 6; the height of the assembly from the floor is adjustable by means of height adjustment mechanism 4. Her feet are on the floor, straddling the main member **3*b* of the elongated base assembly, while her knees rest gently against the cushioned inside edge of the forward tilted knee/leg rest cushion 14*a*. The left armrest assembly 8L has been folded down so as not to hinder a quick exit from the chair, while the right armrest assembly 8R is in the upright position, providing a mounting point for abdominal rest assembly 10**. The varying degree and pressure of her forward lean is supported by the abdominal rest assembly.

In FIG. 28 the worker has changed tasks, switching to a telephone call. By leaning back she has forced seat assembly 7, mounted on spring actuated seat adjustment mechanism 6, into a rearward inclined angle. This allows her to shift body support from the abdominal rest to backrest assembly 12, which is also spring actuated via seat adjustment mechanism 6, and which tilts further backward as her body pressure on it increases. Since the spring tension on both the seat and the backrest force them into a forward default position, a fore and aft weight shift makes the assembly perform like a rocker wherein the seat and back move independently of one another. The abdominal rest has become a convenient forward hand/arm rest. She may rotate the seat assembly to any point in a 360 degree circle without encumbering the legs or feet, and may shift back and forth between abdominal and backrest support. She would also be able to take advantage of the optional headrest assembly 13, not shown in this sequence.

In FIG. 29 the worker has elevated her legs onto the knee/leg rest assembly 14 and assumed a reclining position. She can continue to rock gently in this position, can stretch out further, arms behind her head, until her body is straight and almost prone, and can quickly return to the forward lean of FIG. 27. Again, the extraordinary stability of the elongated base design becomes apparent throughout these movements. Even when a sitter stretches out prone with the arms in a rearward orientation the chair does not tip over. Because the chair's design allows all of these movements to be accomplished without making a single change or adjustment to the mechanisms the configuration is said to be continuously variable.

Figure 31:
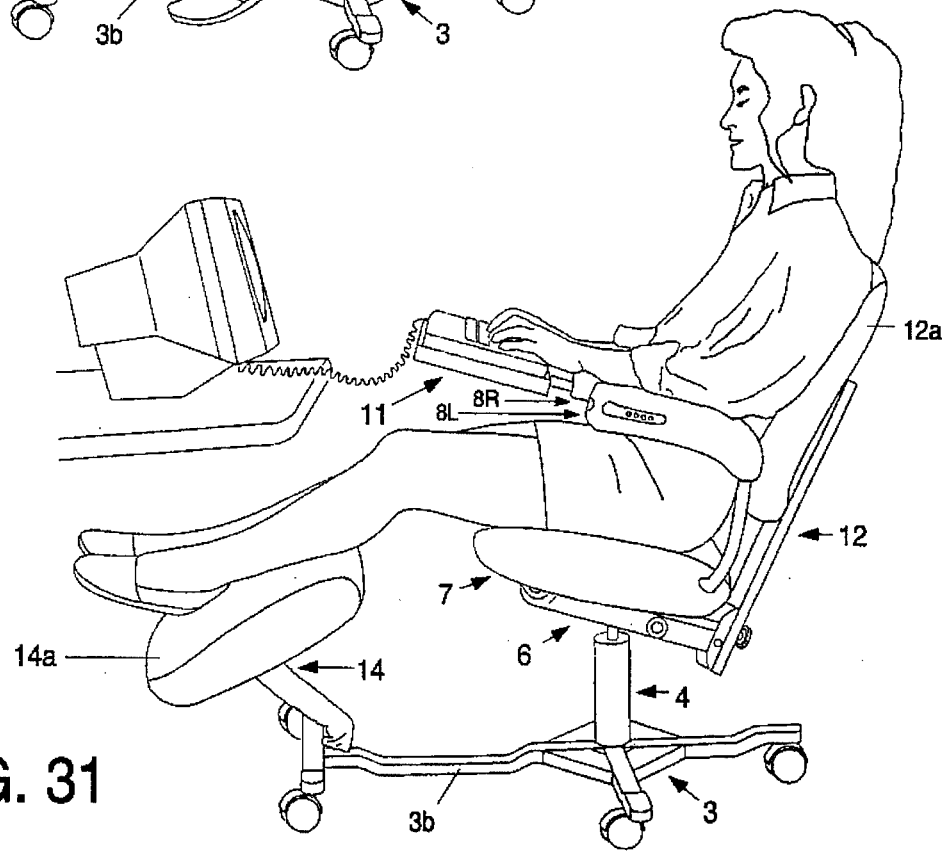

FIGS. 30 and 31 show two applications of the work chair at a detached work station. In FIG. 30 the worker is using knee/leg rest assembly 14 as a knee rest. Because the various elements in the assembly do not have to be locked down tightly a sitter can change the orientation of cushion **14*a*** by simply grabbing it and tilting it fore and aft. One can also disengage the tension mechanism to make the movement easier if necessary. The worker has both armrest assemblies folded up so that they can periodically support the arms, and she is using the abdominal rest to support the varying pressure of her forward lean. From this position she can rock back and forth, shift her body weight to the backrest, and rotate the seat assembly as needed.

In FIG. 31, an example of a hybrid work station, the worker has configured the chair to accommodate a reclining position. Keyboard desk assembly 11 has been attached to armrest assembly 8R, while a computer terminal sits on a detached desk. Both armrest assemblies are folded up to provide constant support for the worker's arms. Due to the combination of being able to recline and gently rock while operating the keyboard this position is extraordinarily useful and comfortable. It is important to note that because the keyboard desk is secured directly to the seat by means of being mounted to the armrest assembly it does not change position relative to the sitter's arms even when the sitter is engaged in a rocking motion. The basic relationship of these movements has been illustrated in FIGS. 4 and 6 where it can be seen that any accessory attached to the armrests will maintain a constant relative position to the seat as the seat tilts on its axis. To leave the chair the worker would fold the free armrest assembly down, or swing the keyboard assembly out, and exit by the side.

Figure 7:
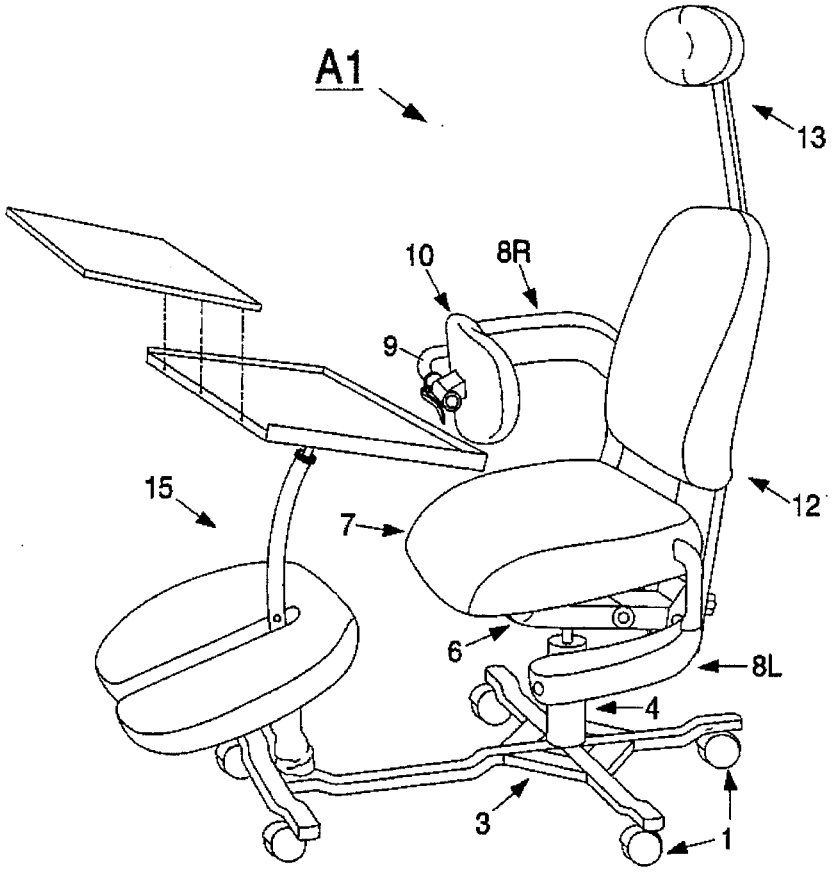
FIG. 7 shows the work chair as a freestanding work station with a detachable auxiliary work surface and abdominal rest.
Figure 8:
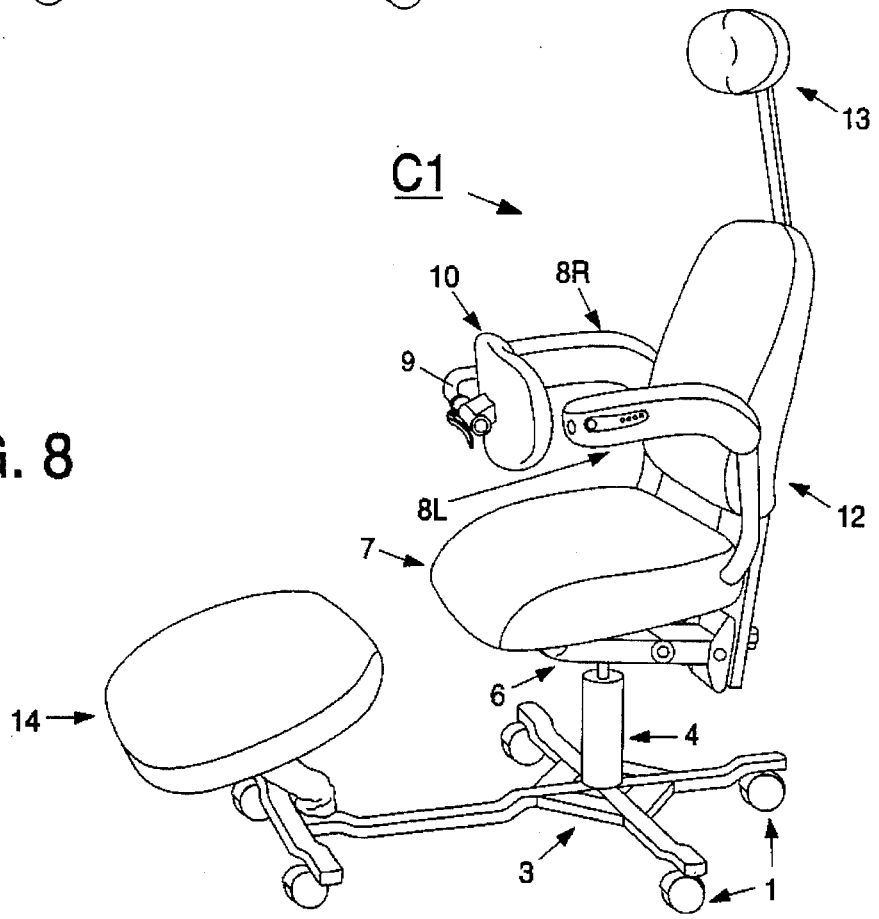
FIG. 8 shows the work chair as a variable posture chair.
Figure 9:
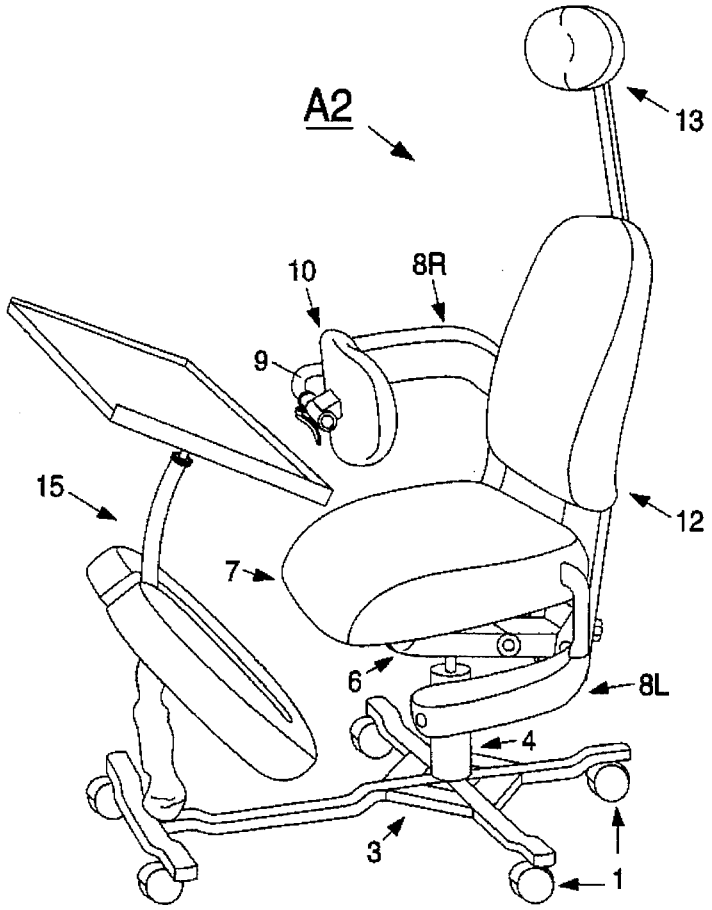
FIG. 9 is another embodiment of a freestanding work station.
Figure 10:
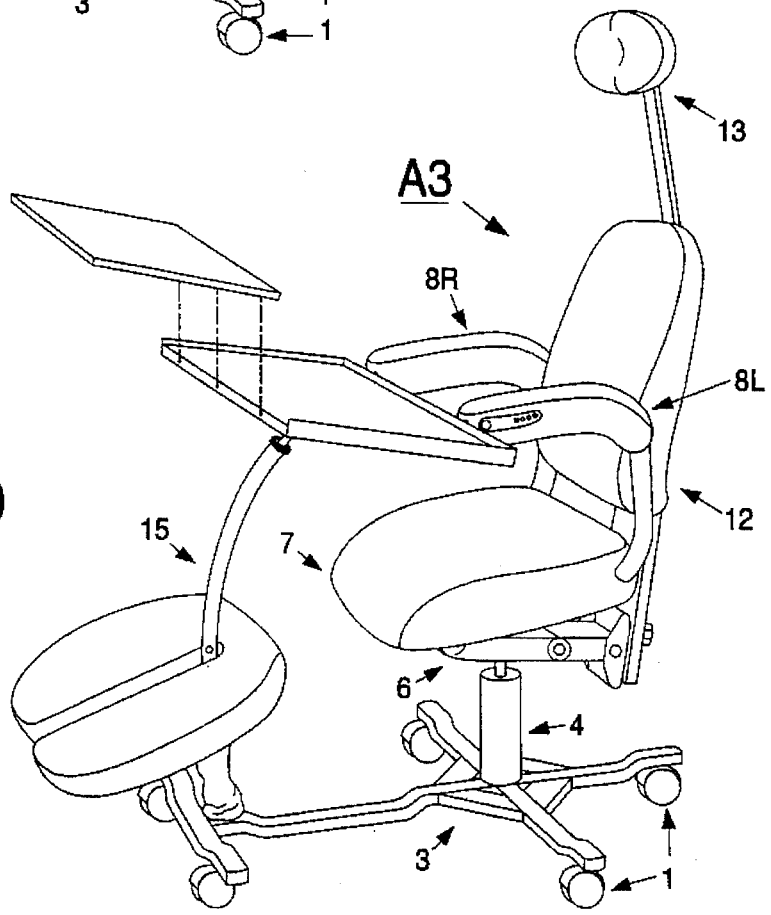
FIG. 10 is another embodiment of a freestanding work station with a detachable auxiliary work surface and no abdominal rest.
Figure 11:
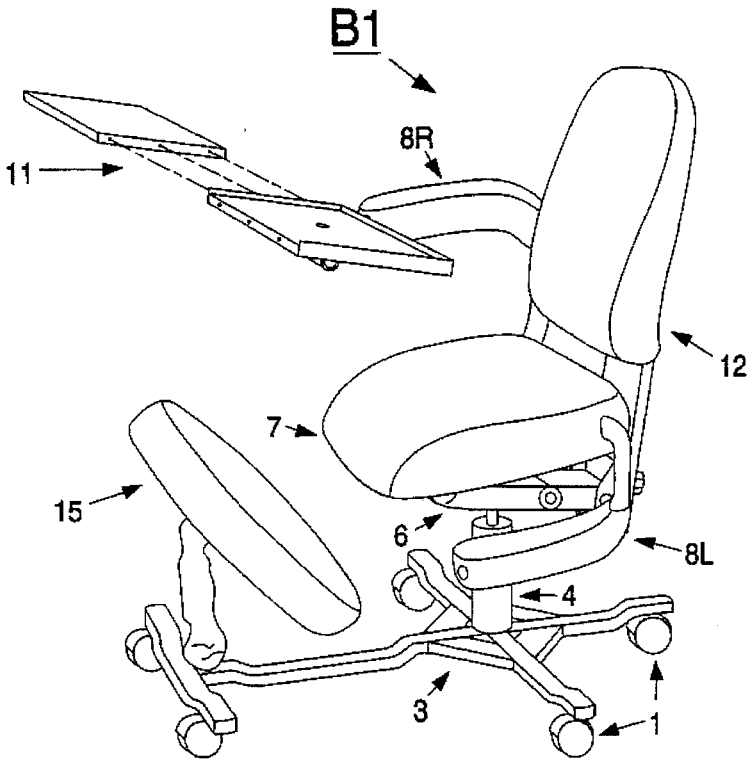
FIGS. 11 and 12 show the work chair as a hybrid work station that may be used either freestanding or in conjunction with another work station.
Figure 12:
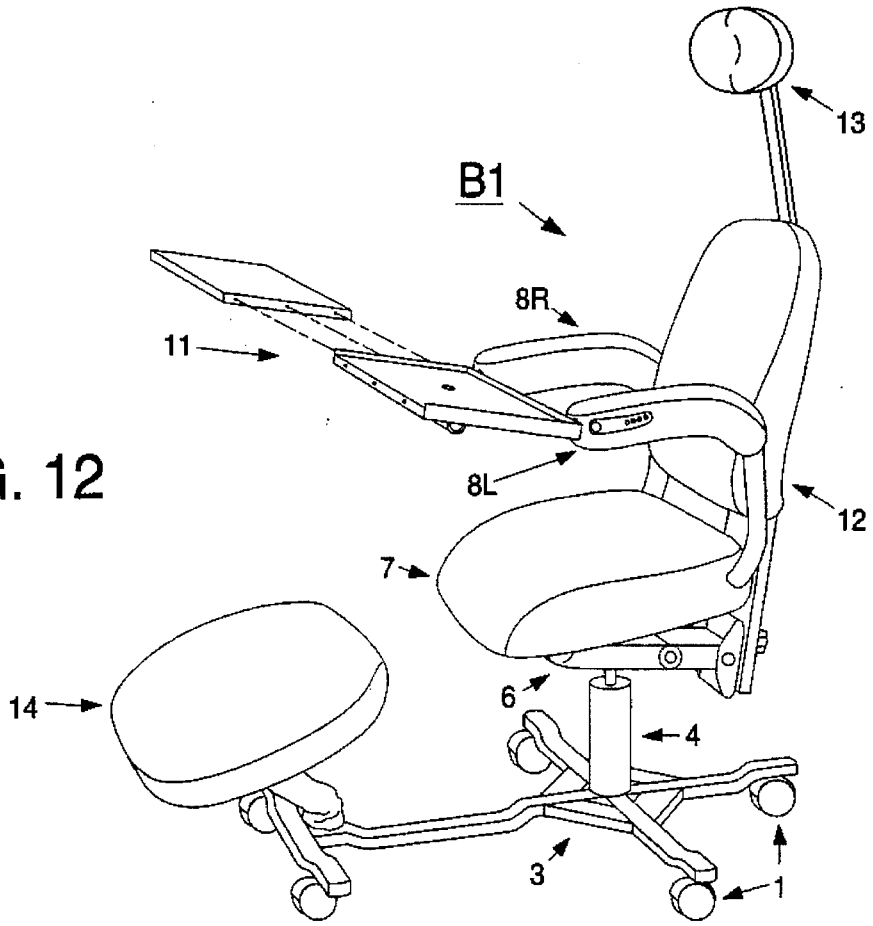
Figure 13:
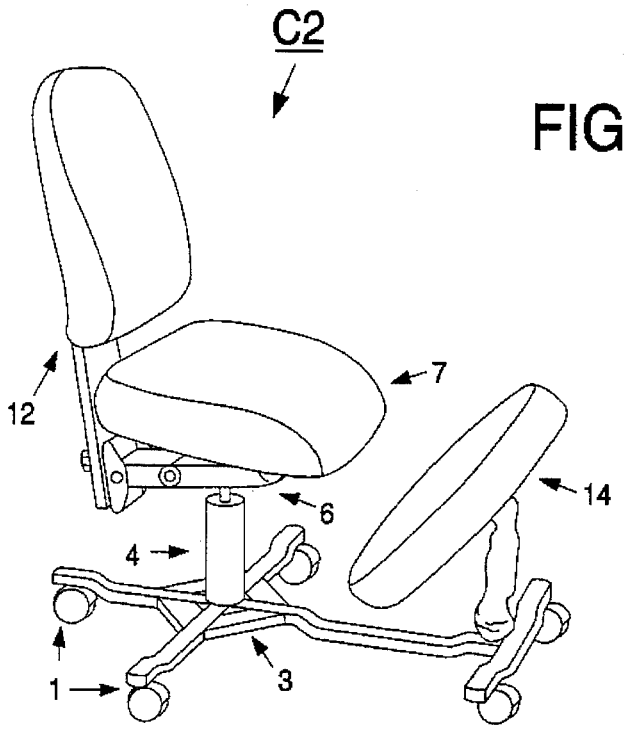
FIGS. 13, 14, and 15 show various embodiments of a variable posture chair.
Figure 14:
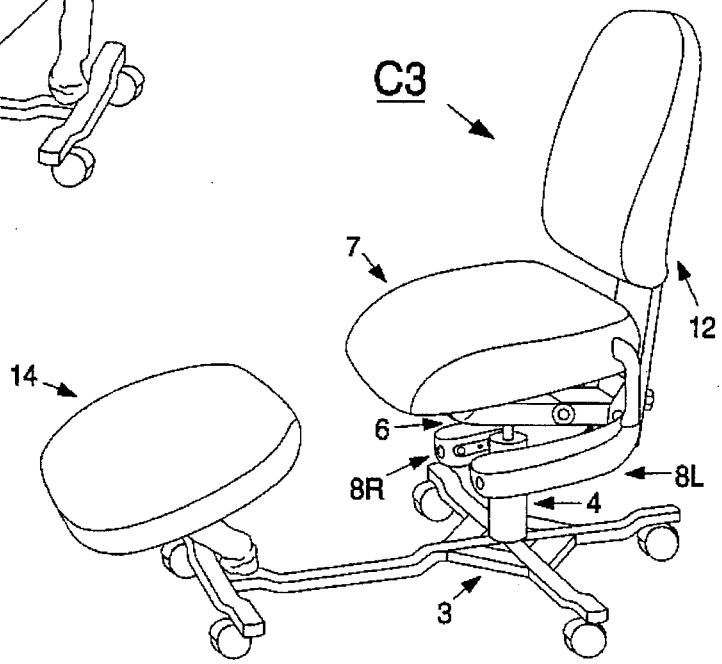
Figure 15:
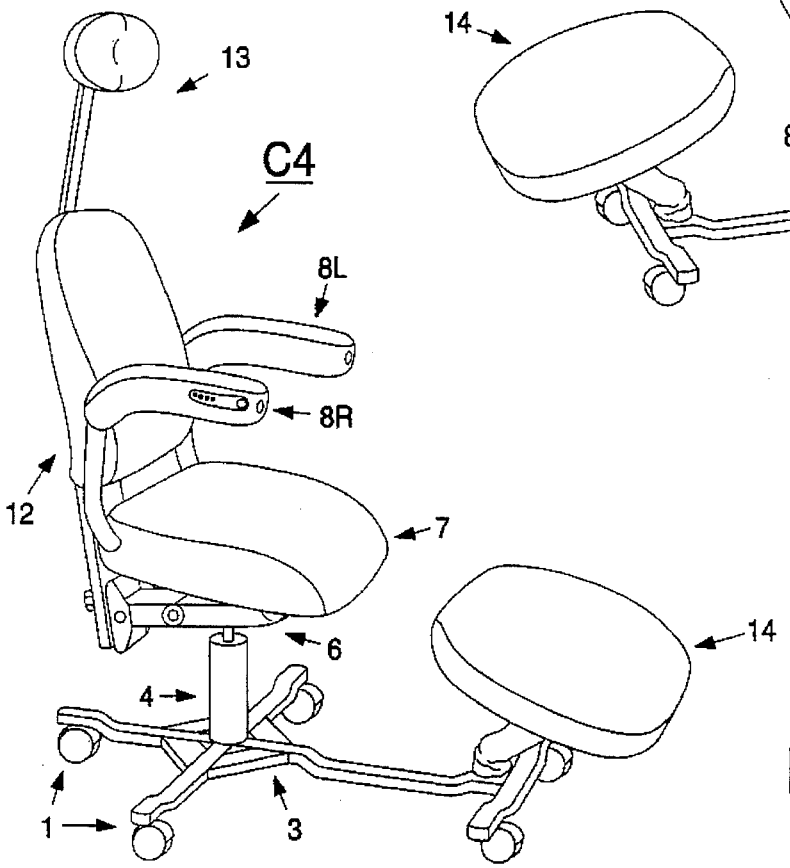
Figure 16:
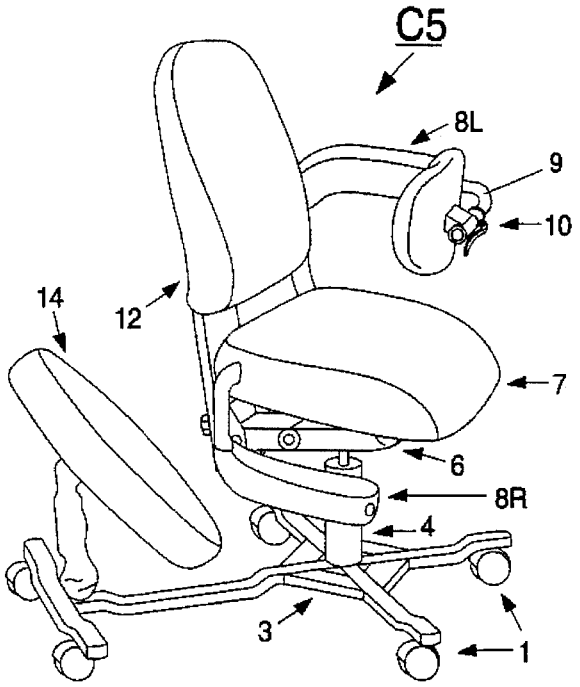
FIG. 16 is another embodiment of a variable posture chair showing functional rotation.
Figure 17:
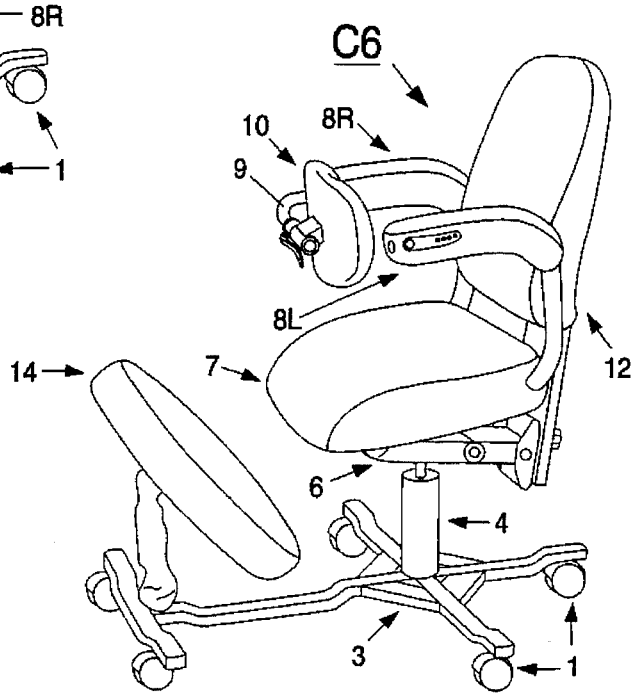
FIGS. 17 and 18 show further embodiments of a variable posture chair.
Figure 18:
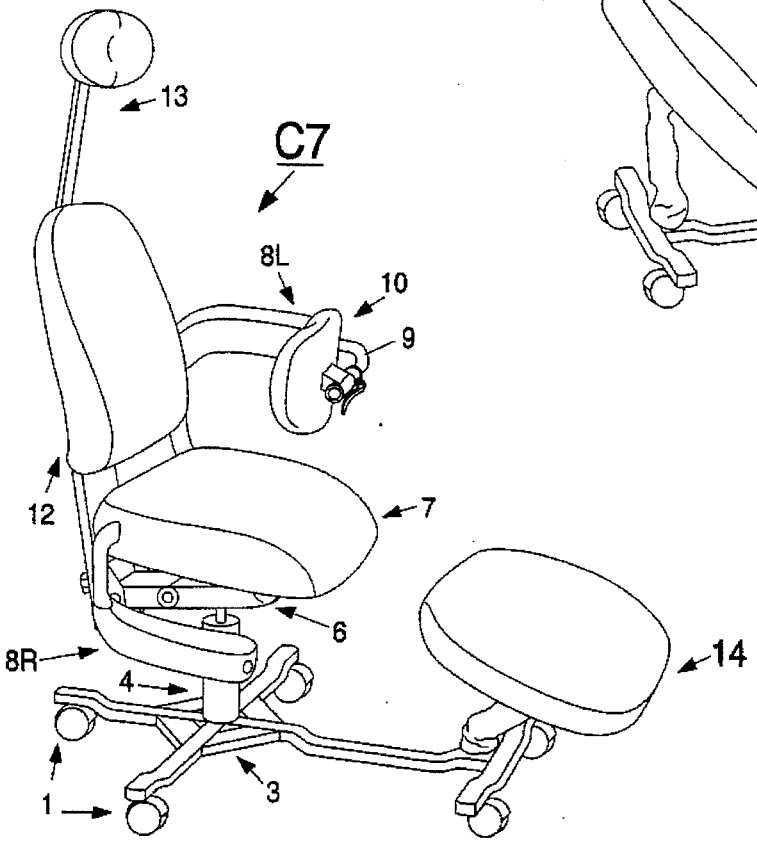
Figure 19:
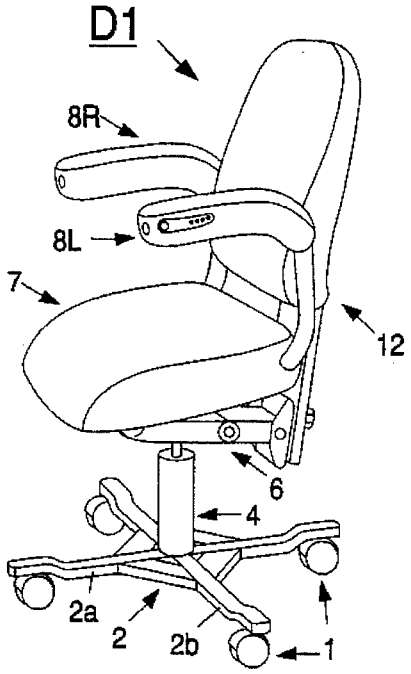
FIGS. 19, 20 and 21 show various embodiments of the work chair on a four point base.
Figure 20:
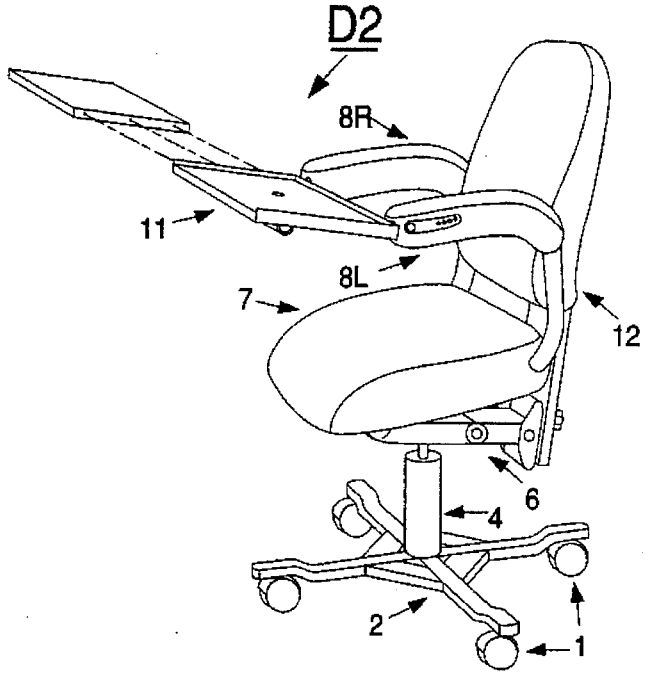
Figure 21:
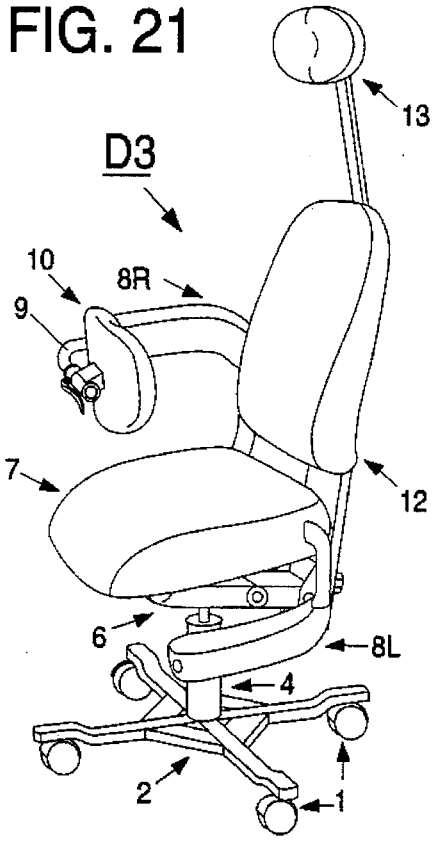

FIGS. 7, 9, and 10 (series A) represent free standing work stations that are a combination of elements shown in FIGS. 1 and 2. The free standing work station configuration is built by mounting auxiliary desk assembly 15 onto the front end of long base assembly 3. The rest of the chair assembly remains as previously described. This configuration differs from the hybrid work station design in that it separates the work surface from the chair assembly, enabling a sitter to turn away from the surface and operate the chair in a conventional fashion. By manipulating the appropriate mechanisms a person can tilt and elevate the desk and leg cushion to satisfactory orientations. Multiple work surfaces may be mounted to the assembly, particularly useful for arranging a keyboard, mouse, paperwork and other accessories. As shown in FIGS. 7 and 9 the abdominal rest assembly may also be employed with this design.

Figure 32:
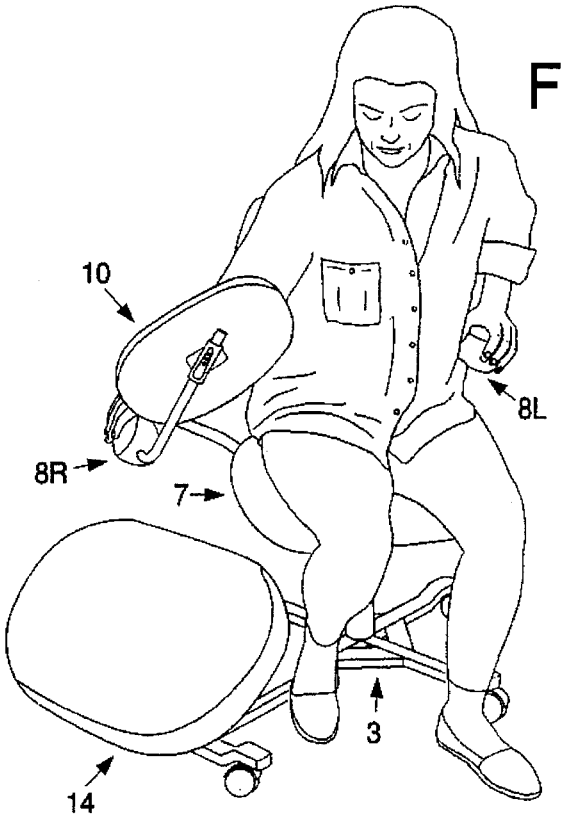
FIG. 32 shows a possible method of entry and exit from the chair when the abdominal rest is attached.
Figure 33:
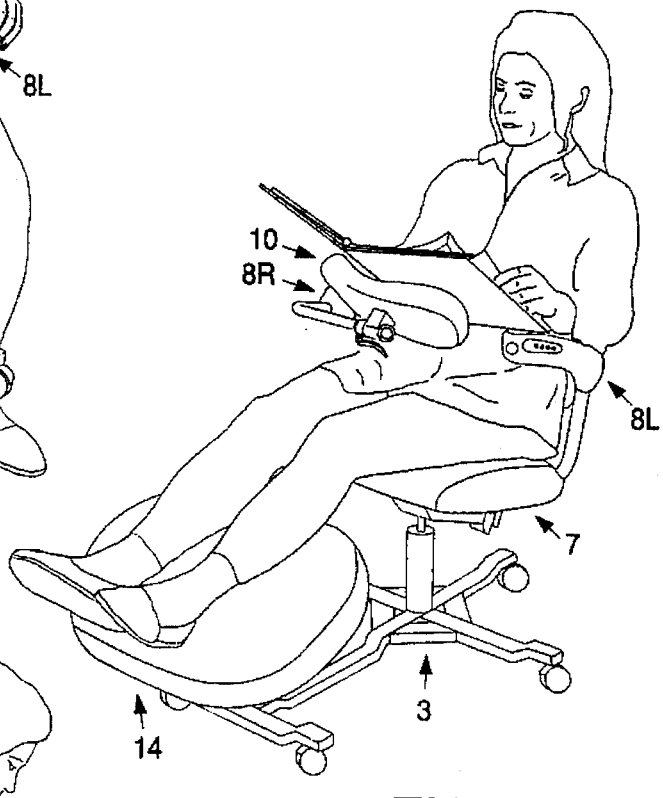
FIG. 33 shows the chair being used for reclining and reading.
Figure 34:
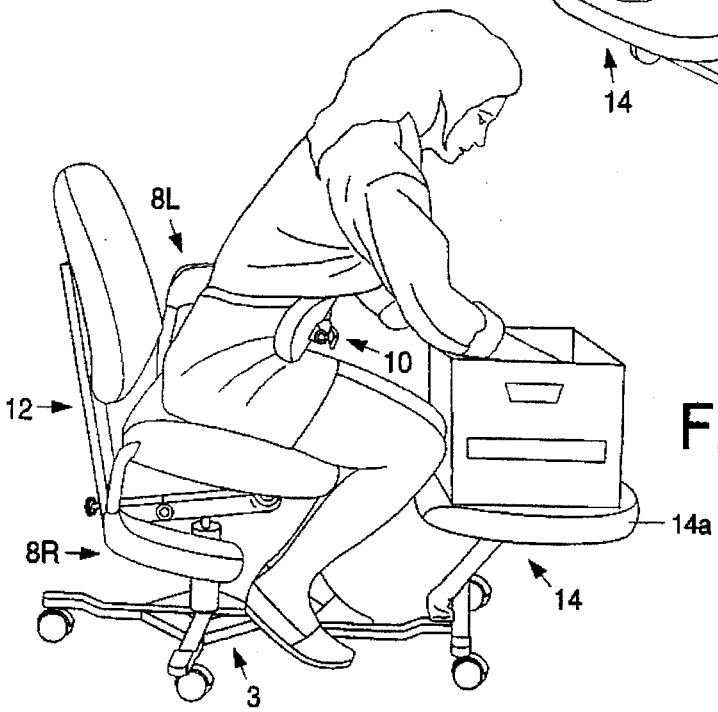
FIG. 34 shows the chair supporting the forward lean while the knee/leg rest used as an auxiliary work surface.

FIGS. 32, 33, and 34 show various other configurations and uses for the chair. In FIG. 32 a sitter is entering or exiting the chair with the abdominal rest 10 in place; this movement will vary with the mechanical design of the accessory support bar and armrests. In FIG. 33 the sitter is using the abdominal rest 10 for a book support while reading, and in FIG. 34 the knee/leg assembly 14 rest has been tilted so that cushion **14*a*** is in a horizontal position and may be used as a supplemental work surface. The seat assembly may, of course, be rotated 90 or 180 degrees from the knee/leg rest to face a free standing work station while the chair is thusly configured; while the knee/leg rest is not needed for certain tasks like operating a sewing machine the ability to transform it into a horizontal work surface is highly useful.

FIGS. 35 through 40 illustrate a component approach to assembling planes of body support. In FIG. 35 the sitter has established a balanced and upright position on the forward tilted seat and is supporting that position with the abdominal rest. Only the short base assembly 2 is needed here; and while this is the simplest configuration of the work chair it should be noted that the sitting position is completely viable. In each successive illustration the configuration changes with different bases and the addition of more planes of support, which have already been described; this increases the level of comfort available to the sitter as well as the number of available sitting options.

Figure 24:
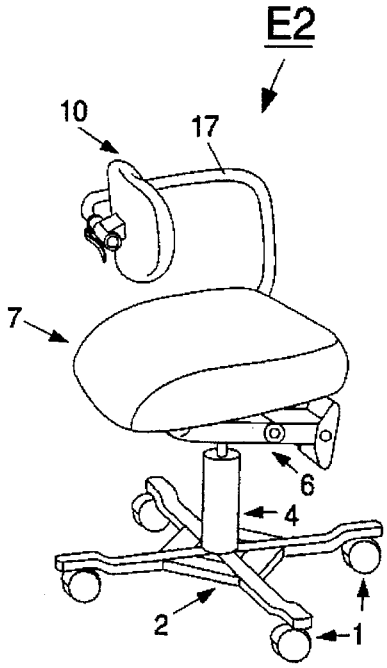
Figure 25:
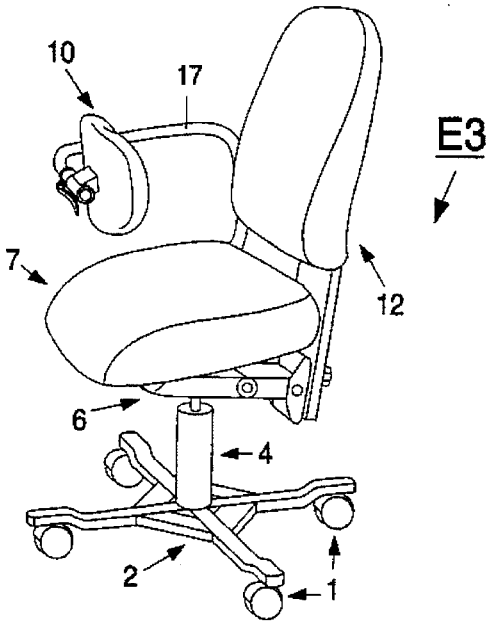
Figure 26:
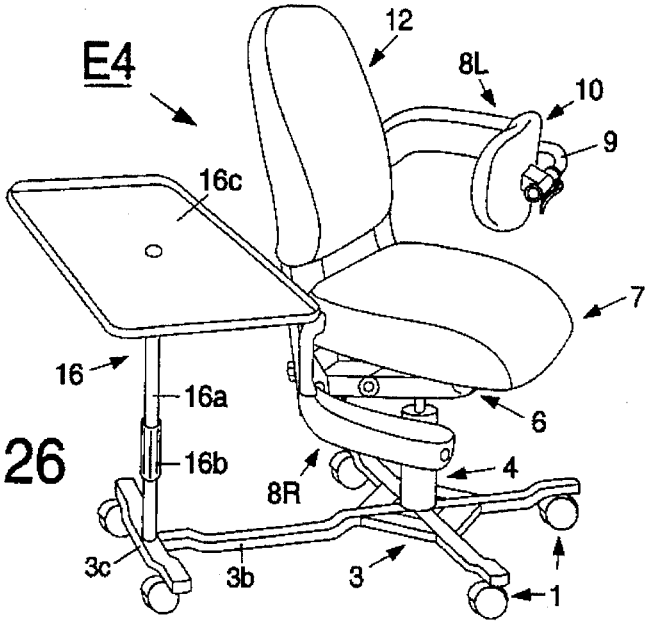

A dentist, jeweler or lab technician might prefer a configuration in the E series (FIGS. 23–26). The tasks performed by someone like a dental hygienist demand a great deal of forward leaning combined with mobility; FIGS. 24 and 25 represent the simplest solution to these needs. The addition of a horizontal work surface or tray for instruments or tools as illustrated in FIGS. 23 and 26 could be very useful for certain industrial applications. Series D centers on the use of a short base assembly 2 (a five point base may also be used) and allows for greater mobility while still providing more support than conventional designs, using elements that have already been described; D4 (FIG. 22) might be useful for a draftsman or architect who must lean forward at an elevated work station.

CONCLUSIONS, RAMIFICATIONS, AND SCOPE OF INVENTION

The great advantage of building a variable posture work chair as a component system is that it provides a variety of critical choices to a sitter dealing with the surprisingly complex problem of long term sitting. By allowing for a plurality of ergonomically correct seating positions this chair offers a range of options that are available in no other seating device. The work chair allows a user to consider his or her specific physical needs—age, infirmity, physique, injury, the ability to tolerate certain sitting positions over others—while precisely mating the device to the nature and duration of the work task at hand.

Once the appropriate configuration is chosen the sitter enjoys the added benefit of continuously variable posture, the ability to go through a series of distinct changes in body position without having to touch a single mechanism. In the case of this invention that means that a sitter may cycle from a forward leaning, supported work position to a backward stretch in which the body is nearly prone and fully extended, then return to a forward position by merely shifting the body weight in the desired directions.

The component design of the system should be welcomed by manufacturers and marketers who can put a great deal of effort and financial backing into a single product with a wide variety of possible applications in the home, office and industrial work place.

While the above description contains many specificities, these should not be construed as limitations on the scope of the work chair, but rather as an exemplification of several possible embodiments thereof. Many other variations are possible, some of which have been discussed above. Accordingly, the scope of the invention should be determined not by the embodiments illustrated, but by the appended claims and their legal equivalents.

I claim the following:

1. A multi-task configurable, continuously variable posture seating device, the seating device comprising:

a base;

a height adjustable support means mounted on said base;

a seat portion;

at least one armrest, the armrest having means for accepting a task accessory;

means for pivotally attaching said armrest to said seat portion;

a backrest;

means for tiltably supporting said seat portion on said height adjustable support means; and means for tiltably supporting said backrest on said height adjustable support means so that independent movement of said seat portion relative to said backrest is provided, and so that the relationship between said seat portion and said backrest may be continuously and independently varied while the relationship between said seat portion and said means for accepting a task accessory remains substantially constant.

2. A seating device according to claim 1, wherein said task accessory comprises an abdominal rest.

3. A seating device according to claim 2, wherein said means for pivotally attaching said armrest to said seat portion comprises:

a shaft having a threaded portion and a portion for attaching to said armrest;

a main member having a hole therein for accepting the threaded portion of the shaft, the main member being fixedly attached to said seat portion; and means for engaging the threaded portion of the shaft and fixing the relative position between the shaft and the main member.

4. A seating device according to claim 1 further comprising a removable support means for supporting a user's knees and calves, said removable support means being removably attached to said base.

5. A seating device according to claim 4, wherein said base comprises:

a cross member;

a main member that is longer than the cross member, the cross member being rigidly attached to the main member in a position such that the main member substantially bisects the cross member and forms a cross having three arms of substantially the same length, and a fourth arm that is longer than the rest of the arms; and a short member that is shorter than said cross member and is attached to the fourth arm at a position that permits the fourth arm to substantially bisect the short member.

6. A seating device according to claim 5, wherein the fourth arm of said base further comprises a section of reduced elevation, so that at least part of the portion of the fourth arm that extends beyond the three arms of substantially the same length will have an overall height that is lower than the height of the three arms.

7. A seating device according to claim 1, wherein said means for accepting a task accessory comprises means for accepting an accessory support bar.

8. A seating device according to claim 7, further comprising an abdominal rest removably mountable on the accessory support bar.

9. A seating device according to claim 7, further comprising a desk surface removably mountable on the accessory support bar.

10. A multi-task configurable, continuously variable posture seating device, the seating device comprising:

a base;

a height adjustable support means mounted on said base;

a seat portion;

at least one armrest, the armrest having means for accepting a detachable abdominal rest;

means for pivotally attaching said armrest to said seat portion;

a backrest;

spring biased means for tiltably supporting said seat portion on said height adjustable support means;

spring biased means for tiltably supporting said backrest on said height adjustable support means so that independent movement of said seat portion relative to said backrest is provided, and so that the relationship between said seat portion and said backrest may be continuously and independently varied; and a removable support means for supporting a user's knees and calves, said removable support means being removably attached to said base, so that independent movement of said seat portion allows alternating use of said removeable support means and said backrest.

11. A seating device according to claim 10, wherein said means for pivotally attaching said armrest to said seat portion comprises:

a shaft having a threaded portion and a portion for attachment to said armrest;

a main member having a hole therein for accepting the threaded portion of the shaft, the main member being fixedly attached to said seat portion; and means for engaging the threaded portion of the shaft and fixing the relative position between the shaft and the main member.

12. A multi-task configurable, continuously variable posture seating device, the seating device comprising:

a base;

a height adjustable support means mounted on said base and having a vertical axis;

a seat adjustment means pivotably mounted on said height adjustable support means so that said seat adjustment means may pivot about the vertical axis of said height adjustable support means;

a seat portion;

at least one armrest, the armrest having means for accepting a detachable desk surface;

means for pivotally attaching said armrest to said seat portion;

a backrest;

a spring biased means for tiltably supporting said seat portion on said seat adjustment means;

means for tiltably supporting said backrest on said seat adjustment means, so that independent movement of said seat portion relative to said backrest is provided, and so that the relationship between said seat portion and said backrest may be continuously and independently varied.

13. A seating device according to claim 12, wherein said means for pivotally attaching said armrest to said seat portion comprises:

a shaft having a threaded portion and a portion for attachment to said armrest;

a main member having a hole therein for accepting the threaded portion of the shaft, the main member being fixedly attached to said seat portion; and means for engaging the threaded portion of the shaft and fixing the relative position between the shaft and the main member.

14. A multi-task configurable, continuously variable posture seating device, the seating device comprising:

a base comprising:

a cross member;

a main member that is longer than the cross member the cross member being rigidly attached to the main member in a position such that the main member substantially bisects the cross member and forms a cross having three arms of substantially the same length and a fourth arm that is longer than the rest of the arms, the fourth arm further comprising a section of reduced elevation, so that at least part of the portion of the fourth arm that extends beyond the three arms of substantially the same length will have an overall height that is lower than the height of the three arms of substantially the same length; and a short member that is shorter than said cross member and is attached to the fourth arm at a position that permits the fourth arm to substantially bisect the short member;

a height adjustable support means mounted on said base;

a seat portion;

at least one armrest, the armrest having means for accepting a task accessory;

means for pivotally attaching said armrest to said seat portion, said means for pivotally attaching said armrest comprises a shaft having a threaded portion and a portion for attachment to said armrest;

a main member having a hole therein for accepting the threaded portion of the shaft, the main member being fixedly attached to said seat portion; and means for engaging the threaded portion of the shaft and fixing the relative position between the shaft and the main member;

a backrest;

means for tiltably supporting said seat portion on said height adjustable support means;

means for tiltably supporting said backrest on said height adjustable support means so that independent movement of said seat portion relative to said backrest is provided, and so that the relationship between said seat portion and said backrest may be continuously and independently varied; and a removable support means for supporting a user's knees and calves, said removable support means being removably attached to said base, so that independent movement of said seat portion allows alternating use of said removeable support means and said backrest.

15. A seating device according to claim 14, wherein said means for accepting a task accessory comprises means for accepting an accessory support bar.

16. A seating device according to claim 15, further comprising an abdominal rest removably mountable on the accessory support bar.

17. A seating device according to claim 15, further comprising a desk surface removably mountable on the accessory support bar.

18. A method for continuously varying the support of a person's posture and varying tasks to be performed by the person on a single seating device, the various tasks requiring continuous variation of the person's posture, the method comprising:

providing a base and a height adjustable support means mounted on said base;

supporting the person's buttocks and upper thighs on a tiltable seat while supporting the tiltable seat on the adjustable support means and while pivotally supporting on the seat at least one armrest with means for supporting and varying a task accessory so that the task to be performed by the person may be varied;

supporting the person's back on a backrest that allows independent movement of the seat relative to the backrest so that the supporting of a person's posture may be continuously and independently varied from primarily the seat to combined support using the seat and the backrest while varying tasks; and providing a knee and calf support means on said base, so that the support of person's posture may be continuously varied from supporting the knee and calf of the person while supporting the buttocks on the seat to supporting the knee and calf while supporting the buttocks and back while varying tasks performed in cooperation with the task accessory.

19. A method according to claim 18, and further comprising the step of cooperatively supporting the posture on an armrest mounted means for abdominal support on at least one armrest so that the person's posture may be continuously varied from cooperatively supporting the posture on the knee and calf support, the seat, and the abdominal support to cooperatively supporting the posture on the knee and calf support, the seat, and the backrest while varying the task.

* * * * *